United States Patent [19]

Gerrans et al.

[11] Patent Number: 4,977,725

[45] Date of Patent: Dec. 18, 1990

[54] PHOTOGRAPH SLIDE SLEEVING SYSTEM

[75] Inventors: Wilbur Gerrans, Snobomish, Wash.; James A. Truc, Wayzata, Minn.

[73] Assignee: Pakon, Inc., Minnetonka, Minn.

[21] Appl. No.: 296,478

[22] Filed: Jan. 12, 1989

[30] Foreign Application Priority Data

Jul. 14, 1988 [EP] European Pat. Off. ..... 8811352

[51] Int. Cl.[5] ..... B65B 43/12; B65B 43/26; B65B 57/20

[52] U.S. Cl. ..... 53/501; 53/564

[58] Field of Search ..... 53/564, 520, 570, 457, 53/501, 75, 567, 569, 158, 538, 266 R

[56] References Cited

U.S. PATENT DOCUMENTS

| | | | |
|---|---|---|---|
| 2,937,483 | 5/1960 | Engelstein | 53/520 |
| 3,381,447 | 5/1968 | Ash et al. | 53/570 |
| 3,579,948 | 5/1971 | Lerner | 53/570 X |
| 3,788,031 | 1/1974 | Florjancic | 53/520 |
| 3,807,121 | 4/1974 | Mundt et al. | 53/564 X |
| 3,872,645 | 3/1975 | Dorman | 53/570 X |
| 3,975,888 | 8/1976 | Jones | 53/386 |
| 4,003,187 | 1/1977 | Kiejzik | 53/520 |
| 4,055,933 | 11/1977 | Getsch | 53/570 |
| 4,139,978 | 2/1979 | Jensen et al. | 53/564 X |
| 4,237,678 | 12/1980 | Thompson | 53/520 |
| 4,391,082 | 7/1983 | Diesch | 53/520 |
| 4,543,771 | 10/1985 | Jensen et al. | 53/520 |
| 4,748,799 | 6/1988 | Truc et al. | 53/457 |

OTHER PUBLICATIONS

Crown Photo Systems, Inc., brochure entitled *Sleevers, Sleeving and Other Photo Products for Your Lab!*, undated.

Loersch Corporation, brochure entitled *Slide Handling Systems and Quickpoint Plastic Slide Mounts*, undated.

*Primary Examiner*—Horace M. Culver
*Attorney, Agent, or Firm*—Kinney & Lange

[57] ABSTRACT

A self-aligning sleever for inserting photograph slides into pockets of an elongated web of sleeving material having a plurality of rows with a predetermined number of pockets per row and spaced from one another by a predetermined row spacing distance. The web of sleeving material is supported for movement in a direction perpendicular to the rows of pockets by a chassis base. A slide shuttle removes photograph slides from a hopper and moves the slides to a first position on a slide support. Photograph slides at the first position are moved to second and subsequent positions in a row corresponding to positions of the pockets in the row of slide sleeving material. A slide counting mechanism mechanically counts the photograph slides moved to the positions on the slide support. Pocket opening means such as coil springs arc the slide sleeving material to open the pockets of the row into which the photograph slides are to be inserted. A slide pusher is actuated when the predetermined number of slides have been positioned on the support means, and push the slides into the corresponding pockets of the row of sleeving material during a first stroke portion. During a second stroke portion the sleeved row of photograph slides and sleeving material by the row spacing distance so as to align a next-adjacent row of pockets with the pocket opening means and slide support. A sleeve clamp clamps the sleeving material with respect to the chassis base during the first stroke portion, and releases the sleeving material during the second stroke portion.

72 Claims, 22 Drawing Sheets

16
20
24
26
30
32
88
90
94
96
98
100
102
104
105
106
108
110
112
114
116
118
120
122
124
126
128
134
136
140
142
152
160
162
190
194
200
212
216
218
220
221
232
F2
408
500
502
504
506
510
511
512
514
558
560
562
566
568
570
572
574
578
580
654
8
10
11

158
118
122
128
88
16
554
206
558
90
500
406
506
502
566
202
220
142
578
574
580
504
P3
6
254
257
252
258
13
262
264
129
200
582
572
514
562
380
216
152
372
166
244
194
140
154
242
214
98
162
168
240
208
56
434
444
29
210
440
510
54
28
36
34
P2
P1

16
88
140
216
214
158
96
94
134
150
32
152
160
136
101
100
P3
148
106
101
P2
154
180
164
166
170
174
136
146
182
242
244
156
167R
P1
240
170
167L
134
169
28
29
176
172
178
144
22

140
16
166
152
156
167 L
167 R
22
54
164
P1
146
308
P2
100
P3
32

28
140
166
16
158
152
160
169
154
156
22
54
22
22
100
164
144
101
106
P1
101
146
101
P2
148
P3
308
32
150

140
216
16
158
166
152
169
156
164
22
22
22
144
308
P1
P2
101
148
32
P3

192
200
16
142
194
190
22
212
22
F1
F2
F3
308
106
32
148
100
101

28
208
192
200
16
142
194
190
212
22
218
F1
22
22
F2
F3
308
106
32
148
100
101

28
208
192
200
16
142
194
190
212
218
F1
22
22
F2
22
100
101
F3
308
106
148
32

90
512
554
158
526
546
516
528
565
547
376
378
D
564
578
556
502
562
560
559
500
406
404

PHOTOGRAPH SLIDE SLEEVING SYSTEM

BACKGROUND OF THE INVENTION

1. Field of the Invention.

The present invention relates to a system for automatically and continuously inserting photograph slides into pockets of sleeving material.

2. Description of the Prior Art.

Developed film and photograph slides made therefrom are packaged in a variety of different manners by photofinishers. Negatives or other strips of film are often inserted into plastic sleeves. A sleever which automatically inserts strips of film into pockets of sleeving material cut from a roll of the material is illustrated generally in the Englestein U.S. Pat. 2,937,483. Sleevers of this type are also shown in a brochure by Crown Photo Systems, Inc. of Evertt, Wash. entitled *Sleevers, Sleeving and Other Photo Products For Your Lab*!.

Individual film images are commonly mounted within slide mounts to form photograph slides. Slide mounters for automatically mounting film transparencies within slide mounts are known and disclosed generally in the following references:

U.S. Pat. No. 4,543,771 Jensen et al.
U.S. Pat. No. 4,237,678 Thompson
U.S. Pat. No. 3,802,121 Mundt et al.
U.S. Pat. No. 3,788,031 Florjancic
Brochure by Loersch Corp. of Allentown, Pa. entitled *Slide Handling Systems and Quickpoint Plastic Slide Mounts.*

Photograph slides have typically been packaged in small boxes for shipping and handling. This packaging is done by hand. Boxing methods are costly, and the box is rather heavy for mailing. Since the film cannot be viewed without removing the slides from the box, they often end up with fingerprint smudges thereon. It has been found to be more efficient and convenient to package photograph slides in transparent sleeving material. A sleeving system which automatically and continuously inserts photograph slides into sleeving material is shown in the Truc et al. U.S. Pat. No. 4,748,799.

Other methods and apparatus for inserting various items into containers are disclosed in the following U.S. patents:

U.S. Pat. No. 3,381,447 Ash et al
U.S. Pat. No. 3,579,948 Lerner
U.S. Pat. No. 3,975,888 Jones There is a continuing need for improved photograph slide sleeving systems. To be commercially viable these systems must be capable of quickly and reliably inserting photograph slides into the sleeving material.

SUMMARY OF THE INVENTION

The present invention is a self-aligning sleever for inserting photograph slides into pockets of an elongated web of sleeving material having a plurality of rows with a predetermined number of pockets per row and spaced from one another by a predetermined row spacing distance. The sleever quickly and reliably inserts the photograph slides into the sleeving material.

One embodiment of the sleever includes chassis base means for supporting the web of sleeving material for movement in a direction perpendicular to the rows of pockets, and hopper means for receiving the photograph slides to be sleeved. Photograph slides are supported in a row by a slide support. Slide shuttle means remove the photograph slides from the hopper means and move the slides to a first position on the slide support. Slide positioning means mechanically coupled to the slide shuttle means move the slides from the first position to second and subsequent slide positions corresponding to positions of the pockets in the row of slide sleeving material into which the slides are to be inserted. The first pocket opening means arc the slide sleeving material adjacent the pockets to open the pockets of the row into which the slides are to be inserted. Slide counting means mechanically count photograph slides moved to the slide support means. Slide pusher means coupled to the slide counter means are actuated when the predetermined number of slides have been positioned on the slide support means. The slide pusher means push the photograph slides from their positions on the slide support means into the corresponding pockets of the row of sleeving material during a first push stroke portion, and push the sleeved row of photograph slides and sleeving material beyond the pocket opening means by the row spacing distance during a second push stroke portion. The next-adjacent row of pockets of the sleeving material is thereby aligned with the pocket opening means and slide support means. Sleeve clamp means releasably clamp the slide sleeving material with respect to the chassis base means. Sleeve clamp actuating means mechanically coupled to the slide pusher means cause the sleeve clamp means to clamp the sleeving material while the pusher means is pushing the slides into the pockets during a first push stroke portion, and to release the sleeving material while the pusher means is pushing the sleeved row of photograph slides and slide sleeving material during the second push stroke portion.

Another embodiment of the sleever also has second pocket opening means. The second pocket opening means includes first and second fingers having pocket engaging tab edges, a finger mount, and mounting means for pivotally mounting the fingers to the finger mount. Biasing means bias the first and second fingers and cause the pocket engaging tab edges thereon to meet and form a tip extending toward the pocket. Cam engaging surfaces extend from the fingers. Drive means including a motor and linkage drives the finger mount into the pocket during a first stroke portion, and drives the cam with respect to the fingers causing the fingers to open during a second stroke portion after the first stroke portion. Slots in the fingers support edges of the photograph slides as they are guided into the pockets when the fingers are opened.

In another embodiment the slide counting means includes an actuator bar means pivotally mounted with respect to the slide support means and having notches in a lower edge corresponding to photograph slide positions. Sensors physically sense the presence of photograph slides at each position in the slide support means. Lever arms of the sensors engage the lower edge of the actuator bar when a slide is not present at the position, and engage a corresponding notch in the actuator bar when a slide is sensed. Coupling means actuates the slide pusher means when photograph slides have been moved to each position of the slide support means and the lever arms are aligned with the notches so as to permit the actuator bar to drop.

In yet another embodiment the slide positioning means includes a guide member mounted with respect to the support means. A moving member is coupled to the slide shuttle means and movably mounted to the guide member for reciprocal motion between extended and retracted positions with the slide shuttle means. A positioning bar is slidably mounted to the moving member and has a first lip with a slide engaging face and a slide disengaging edge. The engaging face of the first lip engages photograph slides moved to a first position by the slide shuttle means and moves the engaged slide to a second position when the moving member is moved to its extended position. The disengaging edge causes the positioning bar to slide on the moving member and be disengaged from the photograph slide in the first position while the moving member is driven to its retracted position. A second lip on the positioning bar also has a slide engaging face and a slide disengaging edge. The slide engaging face of the second lip engages photograph slides moved to the second position by the first lip, and moves the slides from the second position to a third position while the moving member is moving to its extended position. The disengaging edge causes the positioning bar to slide on the moving member and be disengaged from the slide in the second position while the moving member is moved back to its retracted position. Biasing means bias the positioning bar in a manner preventing the second lip from engaging slides in the second position unless a first lip is engaged with the slide in a first position. In other embodiments the support means includes forward and rearward slide edge support members for engaging forward and rearward edges, respectively, of the photograph slides. The slides are thereby supported in the slide positions at a staging level above an insertion level. The rearward slide edge support member includes a gate which is pivotally mounted to the chassis base by pivot means for rocking motion between open and closed positions. An upper edge of the gate supports the rearward edges of the photograph slides in the staging level when the gate is in its closed position. The gate is biased toward its open position. Actuator means coupled to the slide positioning means force the gate to its closed position when the slides are being positioned, and release the gate thereby causing the slides to be dropped to the insertion level after the slides have been placed in their slide positions.

Still other embodiments include a drag brake for applying a drag force to the slide sleeving material. The end of the web of sleeving material is sensed by an end-of-material sensor. A breakaway release mechanism in the slide shuttle means absorbs motion of the shuttle when it is jammed.

OVERVIEW OF SLIDE SLEEVER 10

DETAILED DESCRIPTION OF THE PREFERRED EMBODIMENTS

Figure 1:
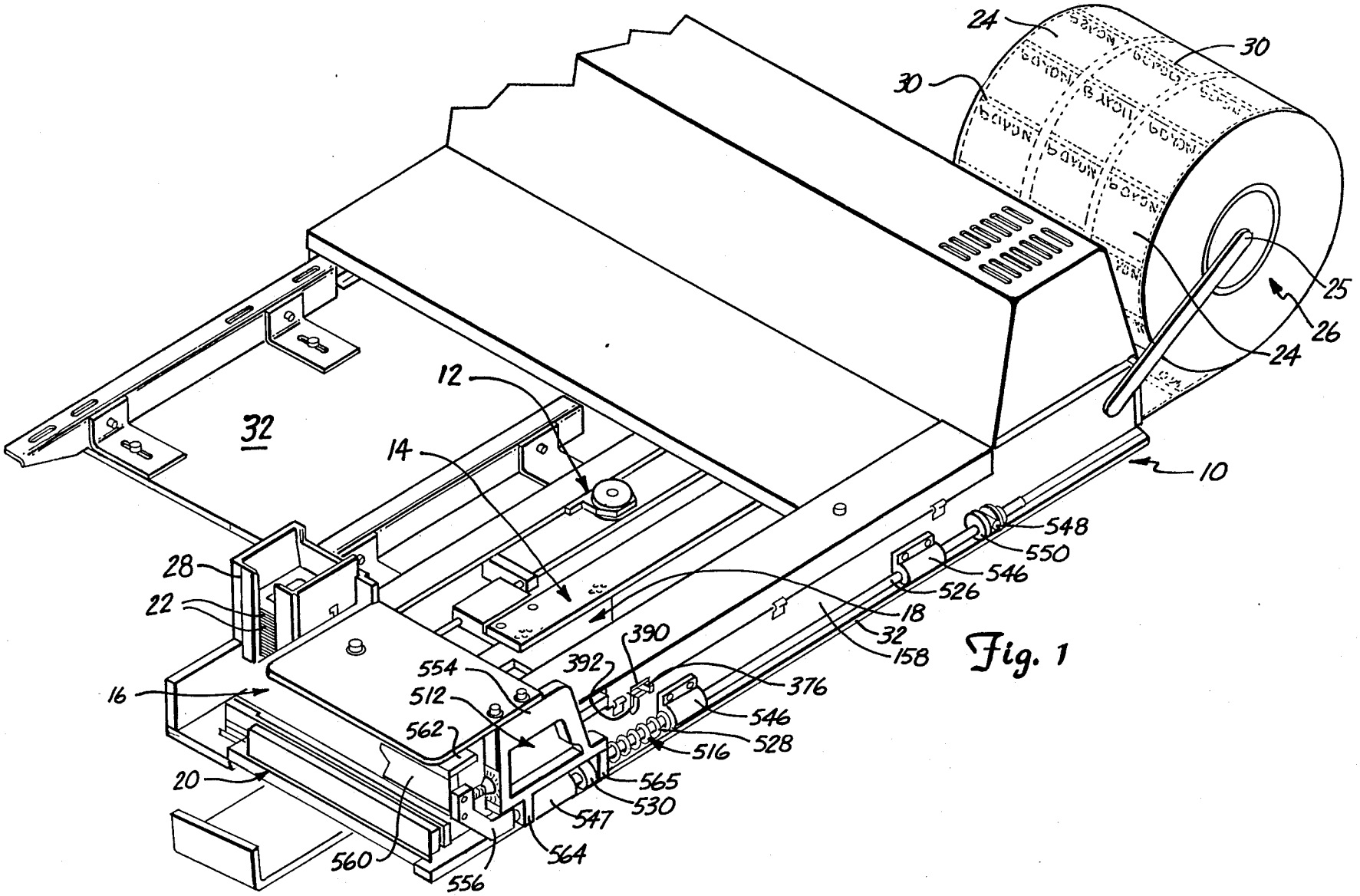
FIG. 1 is a perspective view of a photograph slide sleever in accordance with the present invention.
Figure 2:
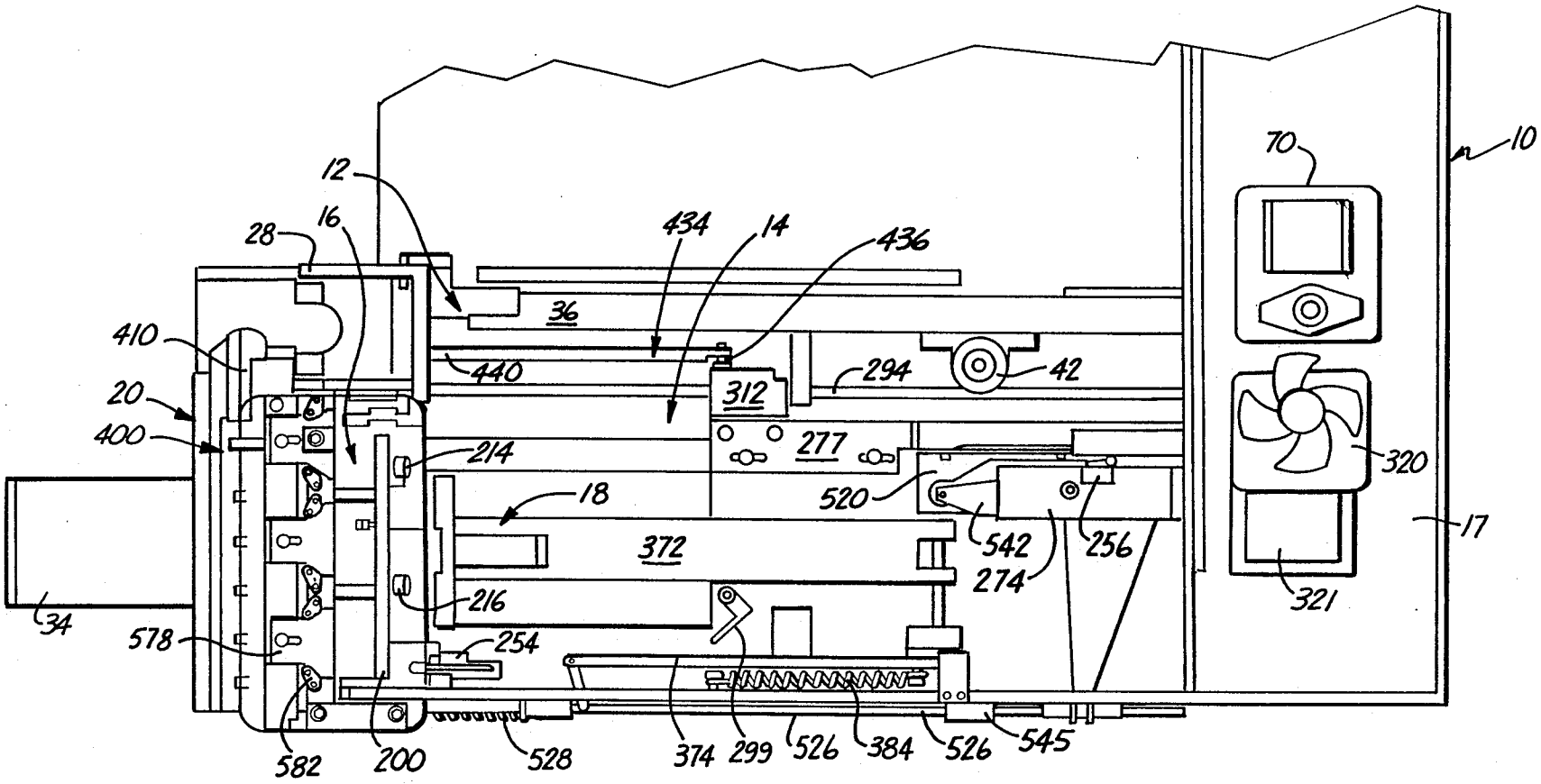
FIG. 2 is a top view of the photograph slide sleever shown in FIG. 1, with the cover removed.

A photograph slide sleever 10 in accordance with the present invention is illustrated generally in FIGS. 1 and 2. Sleever 10 includes a slide shuttle assembly 12, slide pusher assembly 14, slide insertion assembly 16, drag brake 18, and sleeve clamp 20 which cooperate with one another to insert photograph slides 22 into individual pockets 24 of slide sleeving material 26. In the embodiment shown, slide sleever 10 is configured to sleeve standard thirty-five millimeter photograph slides 22 which are sequenced in a desired order and stacked on top of one another within hopper 28. Sleeving material 26 can be provided as a rolled, elongated web. The web has adjacent of rows of pockets 24, and each pocket has a pocket opening slot 30. Sleeving material 26 can be manufactured in accordance with the methods described in copending Application Ser. No. 07/158,243, filed Feb. 19, 1988, entitled "METHOD FOR MANUFACTURING PHOTOGRAPH SLIDE SLEEVING MATERIAL AND SLIDE STORAGE FILES THEREFROM", and assigned to the same assignee as the present invention.

Shuttle assembly 12, pusher assembly 14, insertion assembly 16, drag brake 18 and sleeve clamp 20 are all mounted with respect to chassis base 32. The roll of sleeving material 26 is mounted to a spindle 25 at the rear of sleever 10. The free end of sleeving material 26 is fed under drag brake 18 and pusher assembly 14, and through insertion assembly 16 and sleeve clamp 20, before it emerges from the front of sleever 10 and rests on tray 34. Slide shuttle assembly 12 continuously removes photograph slides 22 one-at-a-time, from the bottom of hopper 28, and positions the slides in a staging area of slide insertion assembly 16. Insertion assembly 16 counts the number of slides received from hopper 28, and moves them to positions adjacent one another in the staging area. Once the number of slides 22 corresponding to the number of pockets 24 in a row of sleeving material 26 (three in the illustrated embodiment) have been positioned in the staging area, they are dropped to an insertion area of insertion assembly 16. Pockets 24 are opened by slide insertion assembly 16. When actuated, slide pusher assembly 14 pushes slides 22 into opened pockets 24 of a row of slide sleeving material 26. While photograph slides 22 are being pushed into pockets 24, sleeve clamp 20 is released, and the filled row of pockets 24 is pushed onto tray 34. Sleeving material 26 is thereby unrolled, and a next adjacent row of empty pockets 24 positioned to receive the next sequential set of photograph slides 22. This procedure is continuously repeated until slides 22 or sleeving material 26 is exhausted. Drag brake 18 keeps a constant pressure on sleeving material 26 to prevent the sleeving material from sliding beyond the position to which it is pushed by slide pusher assembly 14.

SHUTTLE ASSEMBLY 12

Figures 3, 4, 5:
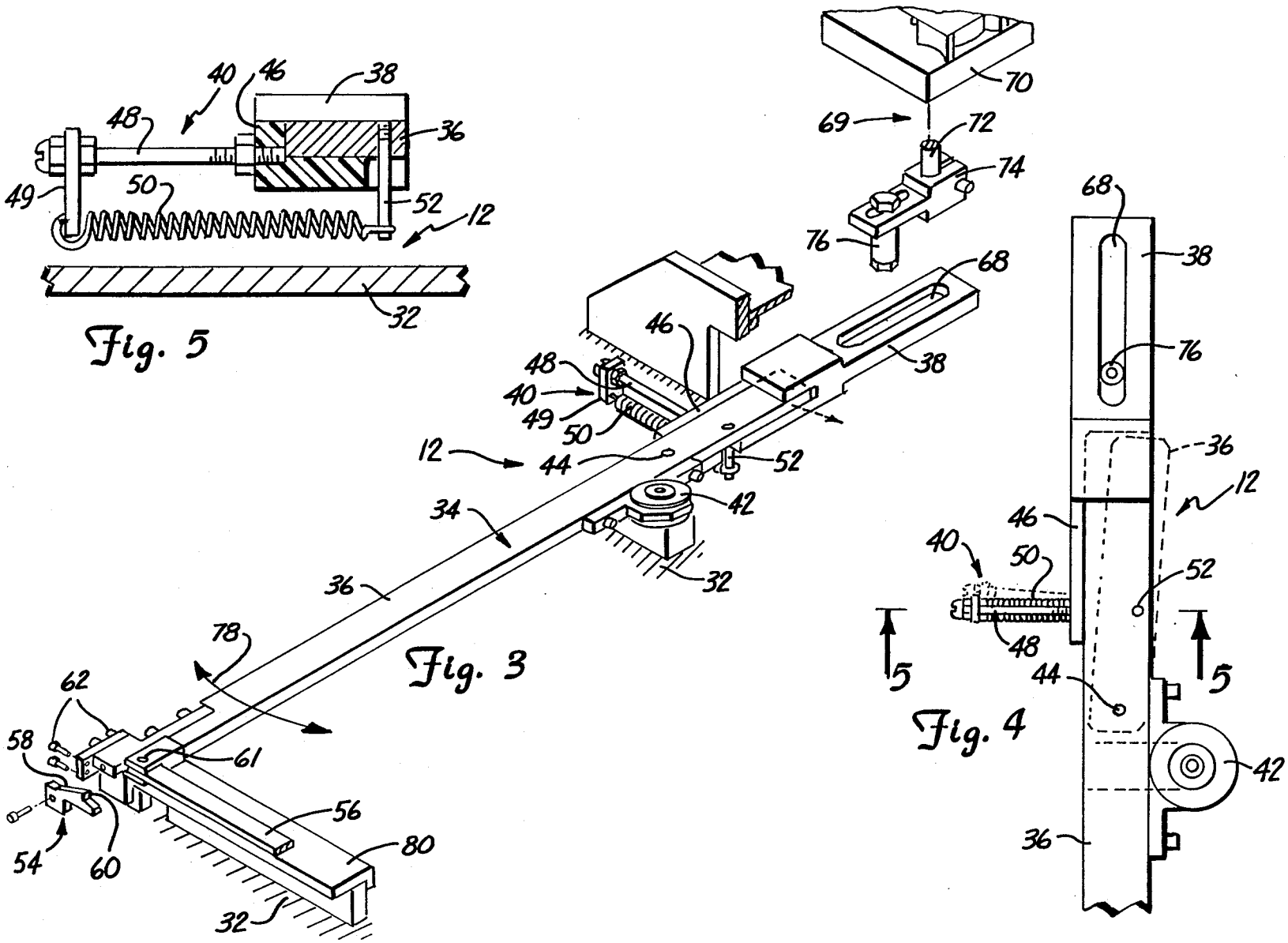
FIG. 3 is a detailed perspective view of the slide shuttle assembly.
FIG. 4 is a detailed top view of a rear portion of the slide shuttle assembly illustrating the action of the breakaway release mechanism.
FIG. 5 is a sectional view of the breakaway release mechanism taken along lines 5—5 in FIG. 4.

Slide shuttle assembly 12 is shown in detail in FIGS. 3–5. Shuttle assembly 12 includes a shuttle arm 34 formed by front member 36 and rear member 38 which are coupled together by a breakaway release mechanism 40. Front member 36 of shuttle arm 34 is rotatably mounted to chassis base 32 by pivot assembly 42. The axis of pivot assembly 42 extends vertically from chassis base 32 to permit shuttle arm 34 to rotate in a plane generally parallel to the chassis base.

Rear member 38 of shuttle arm 34 is connected to front member 36 by a pivot pin 44. Rear member 38 has a raised edge 46 on its left side which abuts a rearmost left edge of front member 36. Arm rear member 38 can thereby rotate about pivot pin 44 in a counterclockwise direction with respect to front member 36, but is prevented from rotating in a clockwise direction beyond the point at which its raised edge 46 abuts the edge of front member 36.

Breakaway release mechanism 40 resiliently holds the left edge of arm front member 36 against raised edge 46 of arm rear member 38. As shown, release mechanism 40 includes a spring mounting bolt 48 which extends laterally from raised edge 46 of arm rear member 38, link 49 which extends downward from bolt 48, pin 52 which extends downward from arm front member 36, and spring 50. Spring 50 has one end connected to link 49 and its opposite end connected to pin 52. Spring 50 thereby resiliently biases the left edge of arm front member 36 into engagement with raised edge 46 of arm rear member 38.

The forward end of shuttle arm front member 36 (i.e. the end opposite pivot assembly 42 from rear member 38) has slide pick 54 and connecting link 56 mounted thereto. Slide pick 54 has a slide engaging face 60 which is oriented to the right of sleever 10 and is generally perpendicular to the plane of motion of shuttle arm 34. Slide pick 54 also has a slide disengaging face 58 which slopes downward and to the left from the upper edge of engaging face 60. Fasteners such as screws 62 are used to secure slide pick 54 to front member 36 of shuttle arm 34. Connecting link 56 extends from the right edge of shuttle arm forward member 36, and is mounted to the front member by pivot pin 61.

Shuttle arm 34 is driven in a reciprocal manner by shuttle drive assembly 69. Drive assembly 69 includes drive motor 70, crank arm 74 and crank pin 76.

Motor 70 is mounted to chassis member 71 (FIG. 2) with its drive shaft 76 extending downward. Crank arm 74 is mounted to and extends in a perpendicular direction from drive shaft 72. Crank pin 76 is mounted to crank arm 74 and extends downward into elongated, longitudinally oriented slot 68 in shuttle arm rear member 38.

Shuttle drive assembly 69 is run continuously while sleever 10 is sleeving photograph slides 22. The rotation of crank arm 74 by motor 70 causes crank pin 76 to move in a circular path as it slides within slot 68 of arm rear member 38. Shuttle arm 34 is thereby reciprocally driven about pivot assembly 42 between a retracted position at which slide pick 54 is at its leftmost position, and an extended position at which the slide pick is at its rightmost position. The reciprocal motion of shuttle arm 34 is indicated by line 78. During its extension stroke (i.e., as it is moving from its retracted to its extended position), slide engaging face 60 of slide pick 54 will engage the left edge of lowermost slide 22 in hopper 28. This motion forces photograph slide 22 into slide insertion assembly 16. During a retraction stroke of arm 34 (i.e. as it is moving from its extended position to is retracted position) disengaging face 58 of slide pick 54 will pass under the current lowermost slide 22 in hopper 28. Slide shuttle assembly 12 is configured in such a manner that slide pick 54 is aligned with a border portion of slides 22. As a result, disengaging face 58 of slide pick 54 will not physically contact the photographic images retained within slides 22 while arm 34 is being driven through its retraction stroke.

In the event that one or more photograph slides 22 gets jammed within hopper 28 or slide insertion assembly 16, or slide pick 54 and shuttle arm front member 36 are otherwise prevented from moving, the motion of arm rear member 38 will be transferred to and taken up by breakaway release mechanism 40. This action of release mechanism 40 is illustrated in broken lines in FIG. 4.

OVERIVEW OF SLIDE INSERTION ASSEMBLY 16

Figure 6:
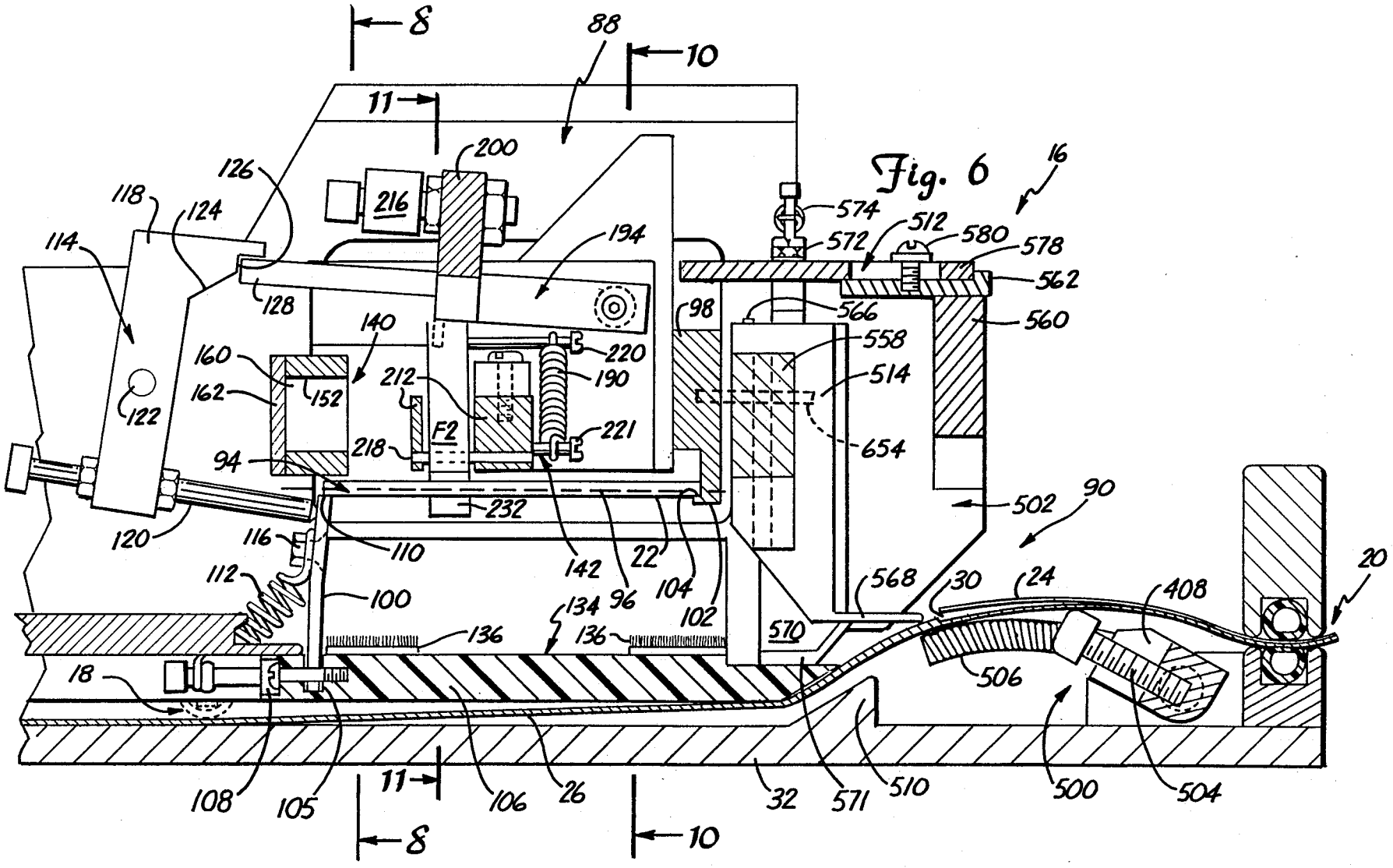
FIG. 6 is a sectional view of the slide insertion assembly taken along lines 6—6 in FIGS. 7 and 28.
Figure 7:
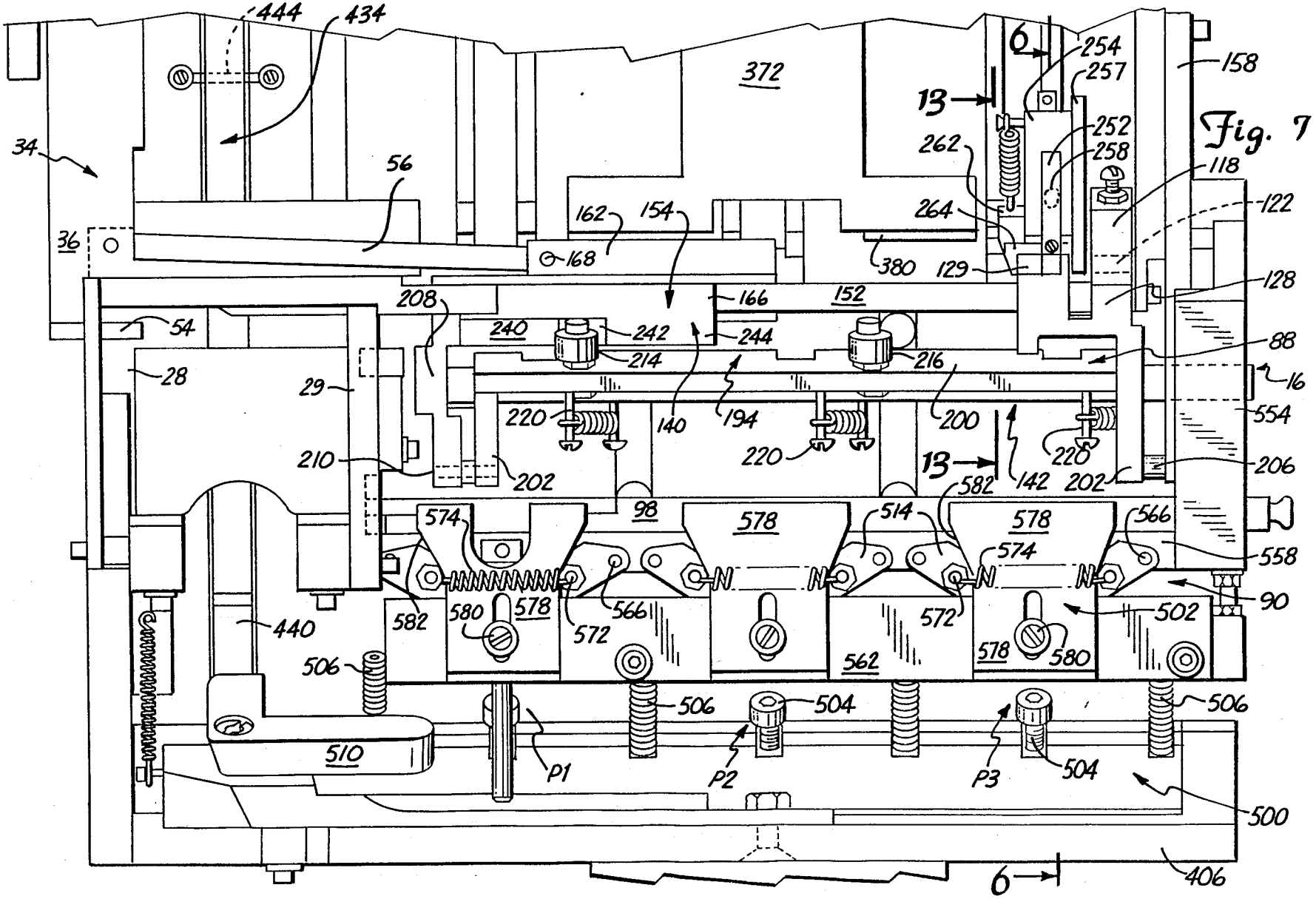
FIG. 7 is a detailed top view of the slide insertion assembly.

Slide insertion assembly 16 is illustrated generally in FIGS. 6 and 7. As shown, slide insertion assembly 16 includes a slide indexing subassembly 88 and a slide sleeve pocket opening subassembly 90. Slide indexing subassembly 88 is formed by slide positioning mechanism 140 and slide counting mechanism 142. Pocket opening subassembly 90 includes a stationary portion 500 and a moving portion 502.

While photograph slides 22 are being moved to staging area 94 by slide shuttle assembly 12 in the manner described above, slide indexing subassembly 88 positions the slides at predetermined locations in the staging area and counts the number of slides which have been positioned. When three photograph slides 22 have been properly positioned in staging area 94, indexing subassembly 88 drops them to insertion area 134 for subsequent insertion into pockets 24 of slide sleeving 26 by slide pusher assembly 14. Pocket opening subassembly 90 opens pockets 24 in the row of sleeving material 26 to be filled so they can receive slides 22.

As perhaps best shown in FIG. 6, the web of slide sleeving material 26 is fed through sleever 10 below drag brake 18, below indexing subassembly 88, and through pocket opening subassembly 90 and sleeve clamp 20 before emerging from the forward end of the sleever. As slides 22 are forced out of hopper 28 by pick 54, they enter indexing subassembly 88 and are initially moved through a staging area 94 which is situated about a staging plane 96 indicated by broken lines in FIG. 6. Slides 22 are supported in staging area 94 by guide bar 98 and gate 100. Guide bar 98 extends across sleever 10 between chassis side wall 554 on the right side of the sleever, and hopper 28. As is described below with reference to pocket opening subassembly 90, guide bar 98 is pivotally mounted to chassis side wall 554, and is releasably secured to right wall 29 of hopper 28. Guide bar 98 has a rearwardly extending lower lip 102 which forms an upwardly oriented ledge 104. Ledge 104 extends along a forward edge of staging area 94 in staging plane 96.

Figure 8:
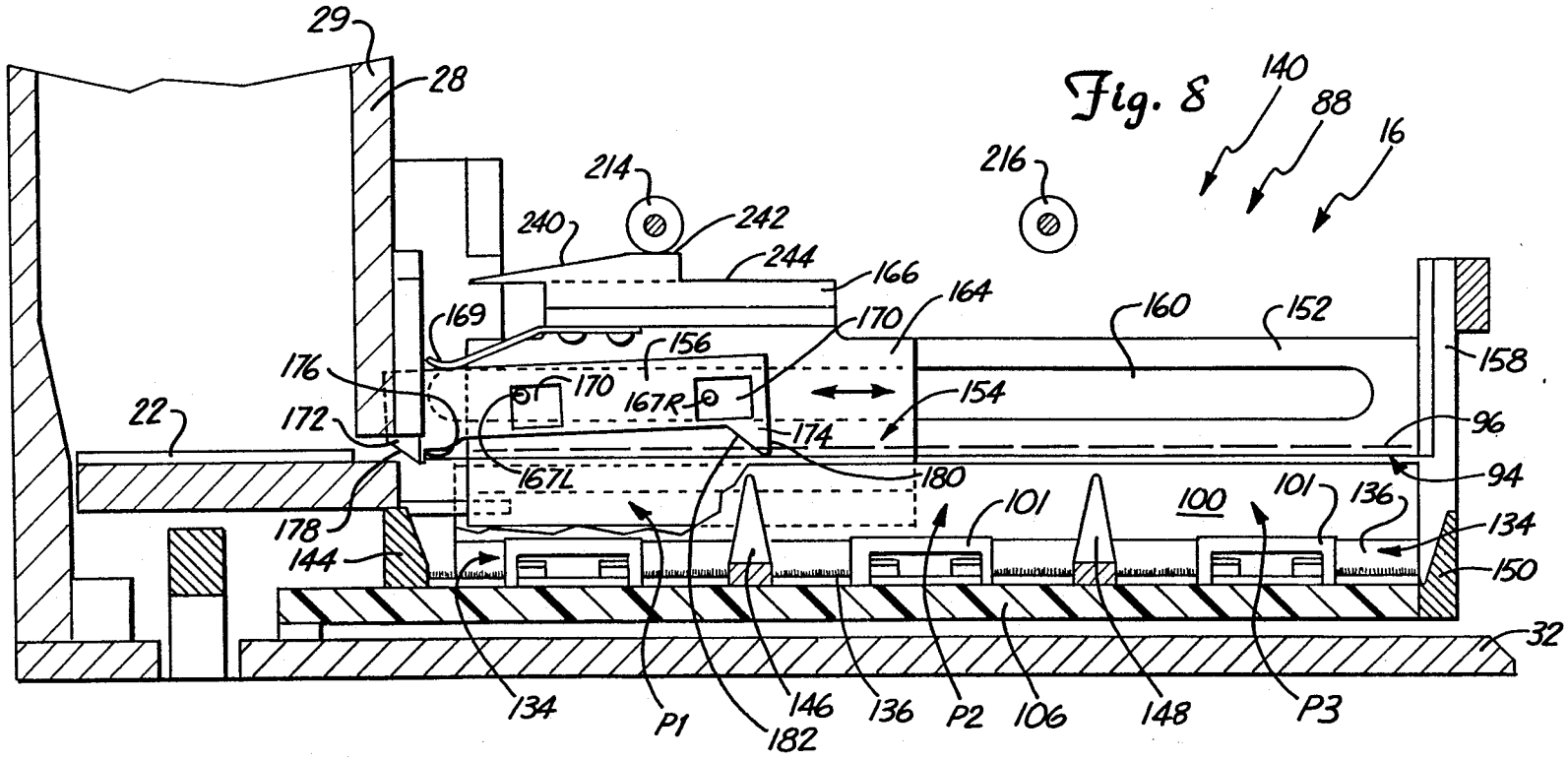
FIG. 8 is a detailed sectional view taken along lines 8—8 in FIG. 6 and illustrating the slide positioning mechanism.

Gate 100 has a lower edge portion which is pivotally mounted within a transversely oriented slot 105 in chassis member 106. Slot 105 has a width which is greater than the width of gate 100 to permit forward-reverse rocking motion of the gate. In the embodiment shown, screws such as 108 are inserted into enlarged holes through gate 100 to pivotally secure the gate to chassis member 106. As shown in FIG. 8, gate 100 has three apertures 101 along its lower edge through which portions of slide pusher assembly 14 can extend. Upper edge 110 of gate 100 extends across the rear edge of staging area 94 in staging plane 96. Photograph slides 22 are supported in staging plane 96 of staging area 94 by gate 100 and guide bar 98. Ledge 104 supports the lower surfaces of the forward edges of slides 22, while the rearmost edges are supported by edge 110 of gate 100.

Gate 100 is shown in its forward or closed position in FIG. 6. As shown, upper edge 110 of gate 100 will be positioned underneath the rearward edge of photograph slides 22 when the gate is in its closed position. Gate 100 is held in its closed position against the bias force of gate opening spring 112 by means of gate release mechanism 114. Spring 112 has a first end attached to gate 100 by fastener 116, and a second end (not shown) secured to a screw 108 extending from chassis member 106. Gate release mechanism 114 is formed by lever arm 118 and pin 120. Arm 118 is pivotally mounted with respect to chassis base 32 by horizontally extending pivot pin 122. Pin 120 is mounted to a lower end of lever 118, and extends forward toward gate 100. An upper forward portion of lever arm 118 has an upwardly sloping edge 124 which terminates with a lip 126. Edge 124 and lip 126 cooperate with a rearward end of gate release lever 128 of actuator bar 194.

In its raised position shown in FIG. 6, lever 1284 of actuator bar 194 is engaged in lip 126. Arm 118 is thereby forceably rotated in a counterclockwise direction about pivot pin 122 to such an extent that pin 120 forces gate 100 to its closed position against the force of spring 112. When bar 194 is lowered, its lever 128 will be disengaged from lip 126 of arm 118. Spring 112 will then pull or rock gate 100 to its rearward or open position (not shown), forcing pin 120 and arm 118 to rotate in a clockwise direction Photograph slides 22 supported by gate 100 and guide bar 98 will then fall downward to insertion area 134. Photograph slides 22 are supported in insertion area 134 above the surface of chassis member 106 by Velcro strips 136.

SLIDE POSITIONING MECHANISM 140

Slide positioning mechanism 140, which is perhaps best described with reference to FIGS. 6–9, receives photograph slides 22 removed from hopper 28 by shuttle assembly 12, and positions these photograph slides in one of three available slide positions P1, P2 and P3. Slide positions P1–P3 extend between staging area 94 and insertion area 134. Slide position P1 is a position adjacent hopper 28 and has its leftmost edge defined by guide member 144 and its rightmost edge defined by guide member 146. Position P2 is opposite position P1 from hopper 28 and has its leftmost edge defined by guide member 146 and its rightmost edge defined by guide member 148. Position P3 is opposite position P2 from hopper 28, and has its leftmost edge defined by guide member 148 and its rightmost edge defined by guide member 150. Guide members 144, 146, 148 and 150 are conically shaped and point upward, thereby facilitating proper positioning of photograph slides 22 within insertion area 134 after they have dropped from staging area 94. Guide members 144, 146 and 148 are all mounted to chassis member 106. Guide member 150 is formed in chassis side wall 158.

Slide positioning mechanism 140 includes guide rail 152, moving member 154 and positioning bar 156. Guide rail 152 is fixedly mounted in a transverse orientation between hopper 28 and chassis side wall 158, and includes an elongated slot 160 which extends therethrough. Moving member 154 is movably mounted to guide rail 152 by means of rollers (not visible) which fit within slot 160. Moving member 154 is formed generally by a rear portion 162 on the back side of guide rail 152, a forward portion 164 which is on the forward side of guide rail 152, and an upper portion 166 which couples rear portion 162 and forward portion 164. Rear portion 162 of moving member 154 is pivotally coupled by pivot pin 168 to an end of connecting link 56 opposite the forward end of shuttle assembly arm 34. Moving member 154 is therefore reciprocally driven back and forth between hopper 28 and chassis side wall 158 as shuttle assembly 12 is driven between its extended and retracted positions.

Positioning bar 156 is movably supported on the forward side of moving member 154 by pins 167L and 167R. Pins 167L and 167R extend outward from front portion 164 of moving member 154. As shown in FIG. 8, positioning bar 156 includes two rectangular apertures 170 into which pins 167L and 167R are inserted, and lips 172 and 174. Apertures 170 are sized to permit positioning bar 156 to move in both horizontal and vertical directions with respect to moving member 154. Lip 172 is on the lower leftmost edge of bar 156, and has a slide engaging face 176 which faces to the right, and a disengaging edge 178 which slopes upward and to the left from the lower edge of face 176. Lip 174 has a slide engaging face 180 and a disengaging edge 182. Face 180 faces to the right, while edge 182 slopes upward and to the left from the lower edge of face 180.

Positioning bar 156 is configured in such a manner that lip 172 will be adjacent the leftmost edge of a slide 22 which has been moved into position P1 of staging area 94 by shuttle assembly 12 when shuttle arm 34 is in its retracted position. Leaf spring 169, which is mounted below a section of moving member upper portion 166, engages an upper edge of positioning bar 156 at a location to the left of pin 167L. Bar 156 is thereby biased in such a manner that lip 172 is forced downward and lip 174 upward, with pin 167L functioning as a pivot point.

Figure 9A:
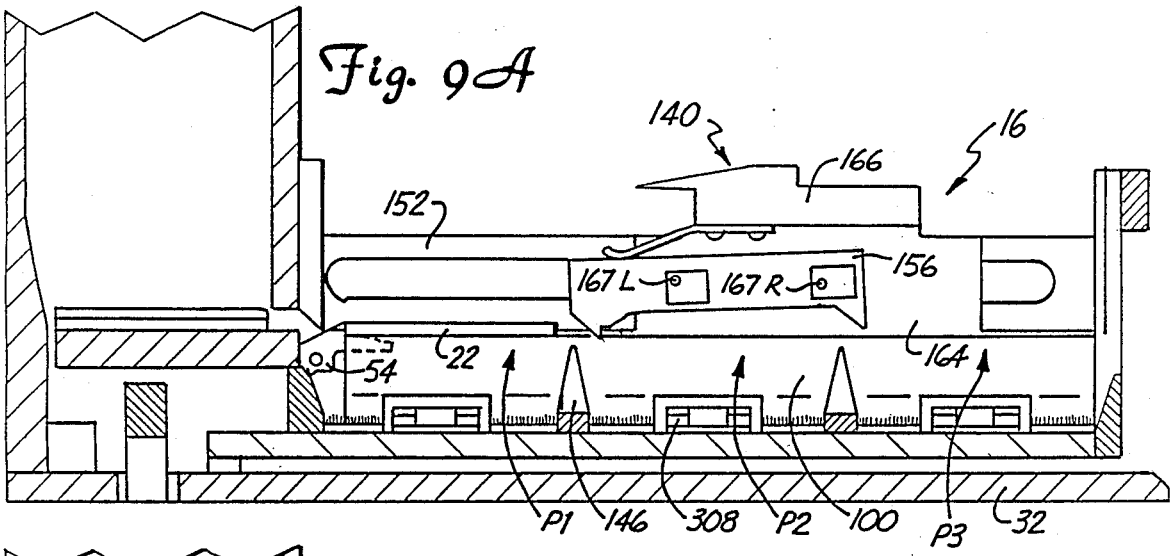
FIGS. 9A–9C are views similar to FIG. 8 and illustrate the operation of the slide positioning mechanism.
Figure 9B:
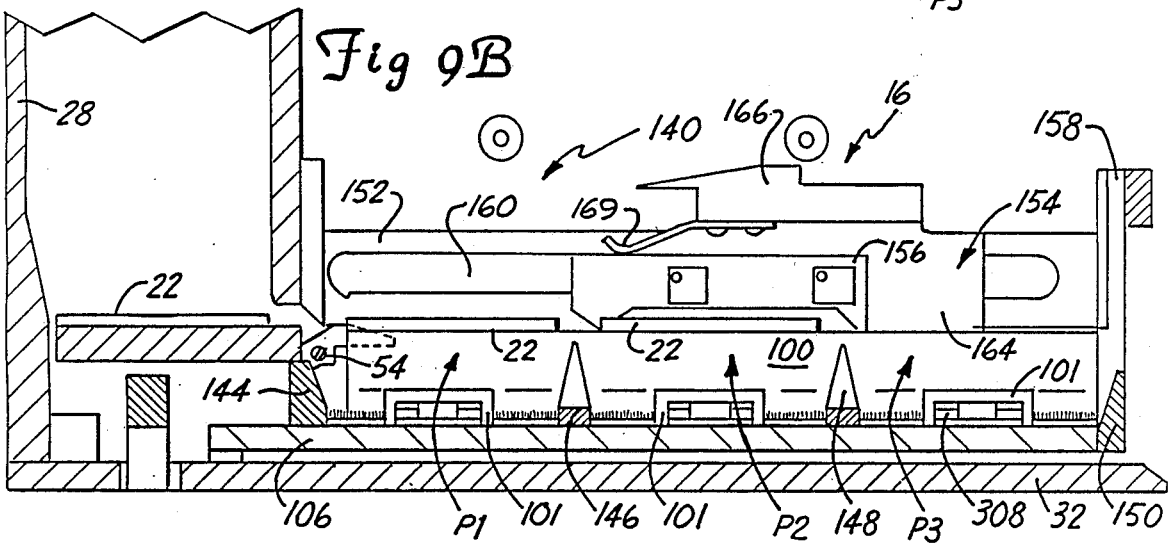

The operation of slide positioning mechanism 140 of slide indexing mechanism 88 can be described with reference to FIGS. 9A–9C. Assuming there are at least three photograph slides 22 within hopper 28, and insertion assembly 16 has finished inserting the previous slides into pockets 24 of sleeving material 26, the positioning operation is commenced when arm 34 of shuttle assembly 12 is driven from its retracted position to its extended position. During this motion, engaging face 60 of slide pick 54 will engage the leftmost edge of the lowermost photograph slide 22, and force it into staging area 94 at position P1. This action is illustrated in FIG. 9A. As discussed above, slide 22 is supported in staging area 94 by top edge 110 of gate 100 and ledge 104 of guide bar 98. The extent of motion of shuttle arm 34 can be adjusted by crank pin 76 along crank arm 74. Shuttle assembly 12 can thereby be adjusted to properly position photograph slides 22 at position P1.

As also described above, moving member 154 is coupled to shuttle arm 34 by connecting link 56. Moving member 154 is thereby driven to the right along guide rail 152 as shuttle arm 34 is driven to its extended position. As shuttle assembly 12 continues its motion, and arm 34 is rotated back to its retracted position, disengaging edge 178 of lip 172 passes over the top of the photograph slide 22 currently in position P1, thereby raising bar 156 with respect to moving member 154 against the bias force of spring 169. Simultaneously, disengaging face 58 of slide pick 54 will pass under the lowest photograph slide 22 currently within hopper 28. When arm 34 has returned to its retracted position, spring 169 will force bar 156 downward while engaging face 176 of lip 172 engages the leftmost edge of photograph slide 22 within position P1, and engaging face 60 of slide pick 54 engages the leftmost edge of slide 22 in hopper 28.

With the next extension of shuttle arm 34, slide pick 54 will again move the lowest slide 22 in hopper 28 into position P1. Photograph slide 22 which had been in position P1 is simultaneously slid to position P2 by lip 172 of positioning bar 156. This action is illustrated in FIG. 9B, where photograph slides 22 are shown in positions P1 and P2. As the motion of arm 34 continues and it is again withdrawn to its retracted position, slide pick 54 will pass under the lowest photograph slide 22 currently in hopper 28 as described above, while lip 172 of positioning bar 156 will pass over and engage the photograph slide 22 which has just been moved to position P1. Simultaneously, disengaging edge 182 of positioning bar lip 174 will pass over the photograph slide 22 which has just been moved to position P2. Engaging face 180 of lip 174 will engage the leftmost edge of the photograph slide 22 in position P2 when shuttle arm 34 has been driven to its retracted position.

When shuttle arm 34 is again driven to its extended position, slide pick 54 will force another slide 22 from hopper 28 into position P1, while lip 172 of positioning bar 156 forces the slide currently in position P1 into position P2. Simultaneously with this action, lip 174 of bar 156 will force photograph slide 22 which was at position P2 into position P3. This action is illustrated in FIG. 9C. Photograph slides 22 will then remain in their respective positions P1–P3 while shuttle arm 34 and moving member 154 return to their retracted positions.

If hopper 28 has only one photograph slide 22 remaining after the previous three photograph slides are inserted into pockets 24 of sleeving material 26, slide positioning mechanism 140 will place that photograph slide into position P2. During the first motion cycle of shuttle arm 34, the sole photograph slide 22 from hopper 28 will be moved to position P1 in the manner described above. During the second and subsequent motion cycle, photograph slide 22 will be moved to position P2 in the manner described above, although there is no remaining slide in hopper 28 to be moved to position P1. Spring 169 therefore pivots positioning bar 156 in a counterclockwise direction while moving assembly 154 is being driven to its leftmost position, forcing the leftmost edge of the positioning bar downward. Since spring 169 forces positioning bar 156 downward at a point to the left of pin 167L, the right side of bar 156 is raised as shown in FIG. 9A. During subsequent motion cycles of shuttle arm 34 and moving assembly 154, lip 174 of bar 156 will pass over the top of, rather than engage, photograph slide 22 in position P2. Photograph slide 22 therefore remains in center position P2 when there are no more slides in hopper 28.

If two photograph slides 22 remained in hopper 28 following the insertion of the previous three slides into the slide sleeving material 26, slide positioning mechanism 140 will position these two slides in positions P2 and P3. The reasons for this action are evident from the above description.

SLIDE COUNTING MECHANISM 142

Slide counting mechanism 142 can be described with reference to FIGS. 6–7 and 10–12. As can be seen in FIG. 7, slide counting mechanism 142 is positioned immediately adjacent to and in front of slide positioning mechanism 140. Counting mechanism 142 includes actuator bar 194, detector fingers F1, F2, F3, finger springs 190, and actuator bar spring 192. Actuator bar 194 includes an elongated main member 200 which extends in a generally transverse direction parallel to guide rail 152, a pair of mounting legs 202, gate release lever 128 and pusher assembly actuating lever 129. Mounting legs 202 extend in a generally forward direction from opposite ends of main member 200. Right leg 202 is pivotally mounted to chassis side wall 158 by pivot assembly 206, while left leg 202 is pivotally mounted to chassis member 208 by pivot assembly 210. Gate release lever 128 and pusher assembly actuating lever 129 extend rearward from the right side of main member 200.

Figure 10:
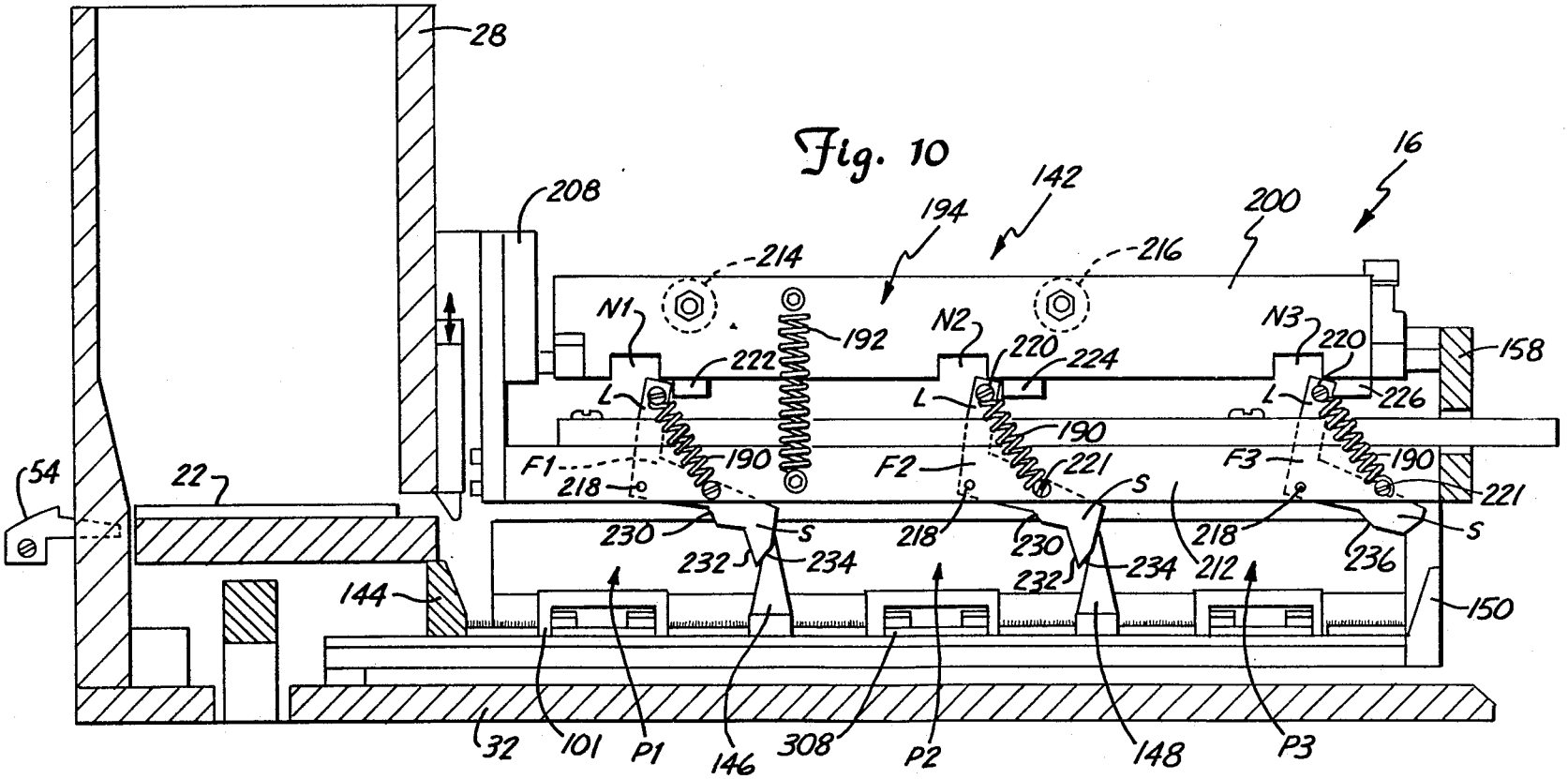
FIG. 10 is a detailed sectional view taken along lines 10—10 in FIG. 6 and illustrating the slide counting mechanism.
Figure 11:
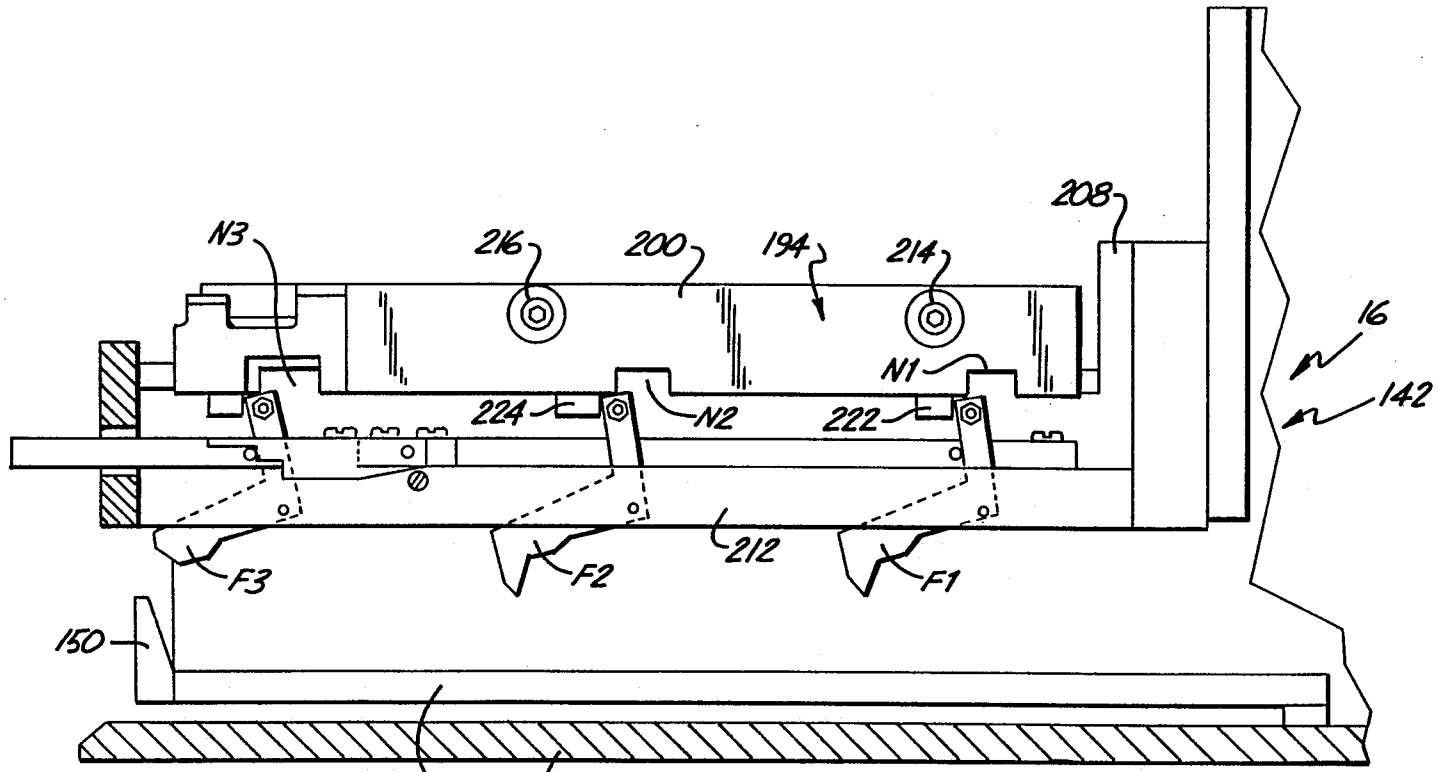
FIG. 11 is a detailed sectional view taken along lines 11—11 in FIG. 6 and illustrating the slide counting machanism.

As perhaps best shown in FIG. 10, main member 200 of actuator bar 194 also has notches N1, N2 and N3 in its lower edge, the notches being centered over slide positions P1, P2 and P3, respectively. Finger stops 222, 224 and 226 extend downward from the lower edge of member 200, adjacent the right edge of notches N1–N3, respectively. Spring 192 biases actuator bar 194 to a normally downward position. As shown, one end of spring 192 is fastened to main member 200 of actuator bar 194, while the opposite end is fastened to chassis member 212. Cam rollers 214 and 216, which cooperate with moving member 154 of slide positioning mechanism 140, are rotatably mounted to the rear side of actuator bar member 200. As shown, roller 214 is mounted to the right of notch N1, while roller 216 is mounted to the right of notch N2.

Chassis member 212 is an elongated bar which extends across insertion assembly 16 below member 200 of actuator bar 194. The right end of member 212 is mounted to chassis side wall 158, while the left end is mounted to chassis member 208. Dectector fingers F1–F3 are pivotally suspended in vertically oriented slots extending through chassis member 212 by means of pivot pins 218. Fingers F1–F3 each include a sensing arm S and a lever arm L. A long pin 220 is mounted near the outer end of lever arm L of each finger F1–F3, and extends over an upper edge of chassis member 212. A pin 221 extends from the front side of chassis member 212 below and to the right of pins 220. Springs 190 are stretched between and mounted to respective pins 220 and 221. Springs 190 thereby bias detector fingers F1–F3 in a clockwise direction so that the end of their lever arms L will be engaged with respective stops 222, 224, and 226 when actuator bar 194 is in its raised position.

The lower edges of sensor arms S of fingers F1 and F2 have a first sloping surface 230 and a second sloping surface 232. The outer ends of sensor arms S of fingers F1 and F2 have slide engaging surfaces 234 which extend from sloping surface 232. The lower edge of sensor arm S of finger F3 has a sloping surface 236. Surfaces 230 and 232 of fingers F1 and F2, and surface 236 of finger F3, are adapted to be engaged by photograph slides 22 as the slides are moved across staging area 94 by slide shuttle assembly 12 and positioning mechanism 140. As surfaces 230, 232 and 236 are engaged by photograph slides 22, respective fingers F1–F3 will be rotated against the bias force of springs 190 and their lever arms L moved from engagement with stops 222, 224 and 226 into alignment with notches N1–N3.

The manner in which counting mechanism 142 counts the number of photograph slides 22 moved into staging area 94 is perhaps best described with reference to FIGS. 12A–12C. The actions of counting mechanism 142 illustrated in FIGS. 12A–12C correspond to the actions of slide positioning mechanism 140 shown in FIGS. 9A–9C. After a slide 22 has been moved into position P1, it will engage sloping surface 130 of finger F1. Finger F1 is thereby rotated in a counterclockwise direction to such an extent that the end of its lever arm L will be vertically oriented adjacent slot N1 of actuator bar 194. This action is shown in FIG. 12A.

Figure 12A:
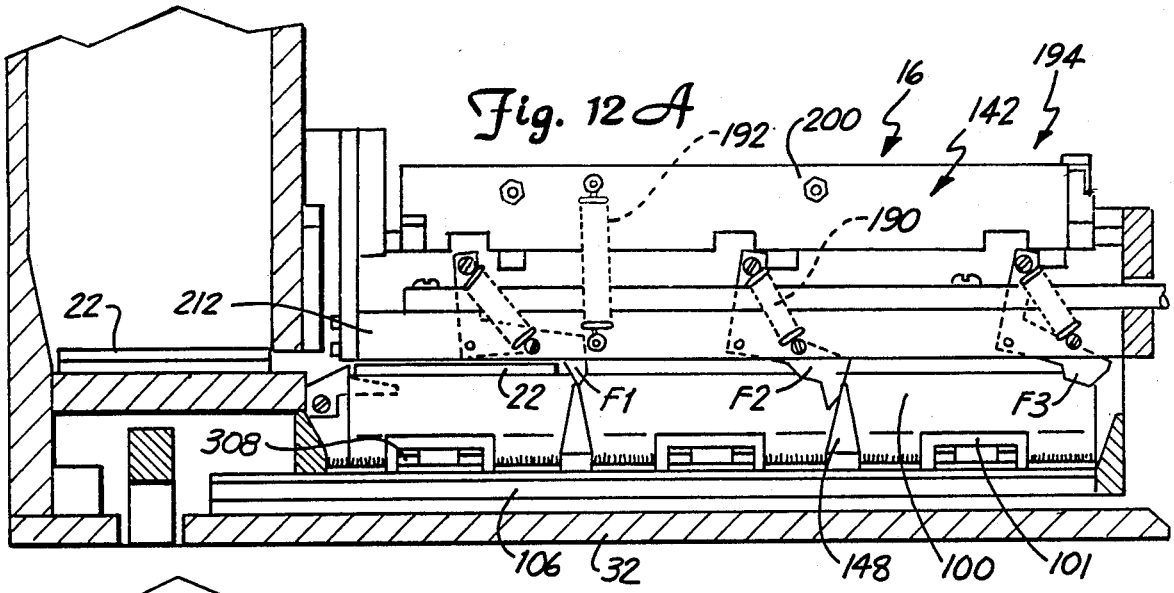
FIGS. 12A–12C are views similar to FIG. 10 and illustrate the operation of the slide counting mechanism.
Figure 12B:
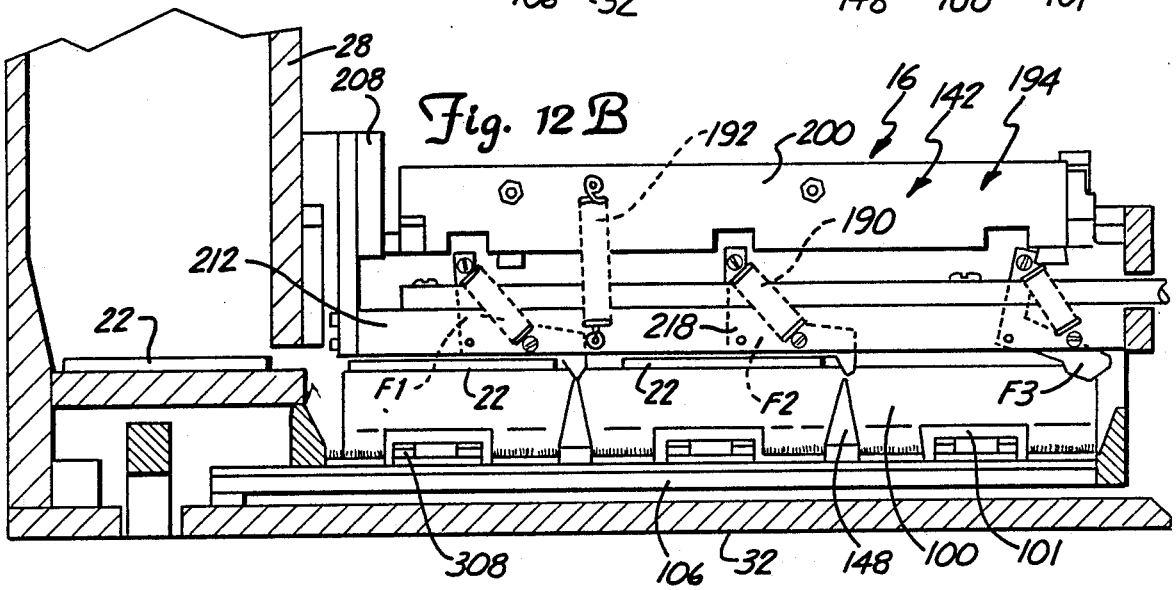

As slide 22 shown in position P1 in FIG. 12A is moved to position P2 by slide positioning mechanism 140, it will engage sloping surface 232 of finger F1, permitting sensor arm S of the finger to pass over the slide. As slide 22 continues to be moved to position P2, it will engage sloping surface 230 of finger F2. Finger F2 will thereby be rotated against the bias force of spring 190 in such a a manner that its lever arm L will be vertically aligned with notch N2 of actuator bar 194. A photograph slide 22 which is simultaneously moved from hopper 28 into position P1 will rotate finger F1 in a similar manner as previously described. The positions of fingers F1–F3 after two slides 22 have been moved into staging area 94 are illustrated in FIG. 12B.

A third photograph slide 22 from hopper 28 is next moved into position P1 of staging area 94. Concurrently, slide positioning mechanism 140 moves the photograph slide 22 in position P2 to position P3, and the photograph slide in position P1 to position P2. While slide 22 is being moved from position P2 to position P3, it will engage sloping surface 232, causing finger F2 to pass over the slide. When in position P3, the slide 22 will engage sloping surface 236 of finger F3, rotating the finger in such a manner that its lever arm L is positioned adjacent notch N3. Lever arms L of fingers F1 and F2 will also be positioned adjacent notches N1 and N2 by the photograph slides 22 moved to positions P1 and P2, respectively. The positions of fingers F1–F3 after three photograph slides 22 have been moved into staging area 94 are illustrated in FIG. 12C.

When fingers F1–F3 are all engaged by photograph slides 22, they will be rotated so that their lever arms L will be positioned adjacent respective notches N1–N3. Since lever arms L are no longer supporting main member 200 of 10 actuator bar 194, the actuator bar will be forced downward by spring 192.

Referring to FIG. 6, it will be seen that when actuator bar 194 is allowed to drop to its lowered position, gate release lever 128 will swing downward out of lip 126 and along edge 124 of arm 118. Arm 118 will thereby be allowed to rotate in a clockwise direction as previously described, opening gate 110. Slides 22 in positions P1–P3 of staging area 94 then will fall downward into corresponding positions in insertion area 134. Guide members 144, 146, 148, and 150 help ensure that photograph slides 22 are positioned in proper positions P1–P3 of insertion area 134 after they are dropped. Velcro strips 136 support slides 22 above chassis member 106 in insertion area 134.

Referring back to FIGS. 7 and 8, upper portion 166 of moving member 154 is shown to include ramping reset surface 240, flat reset surface 242, and pusher assembly delay surface 244. Surfaces 240, 242, and 244 are adjacent to one another and positioned with respect to main member 200 of actuator bar 194 in such a manner that they will be engaged by cam rollers 214 and 216 when moving member 154 is driven by shuttle assembly 12. Ramping reset surface 240 slopes upward from the leftmost edge of moving member upper portion 166 and intersects flat reset surface 242. Pusher assembly delay surface 244 is a horizontally oriented surface below the level of surface 242.

Figure 9C:
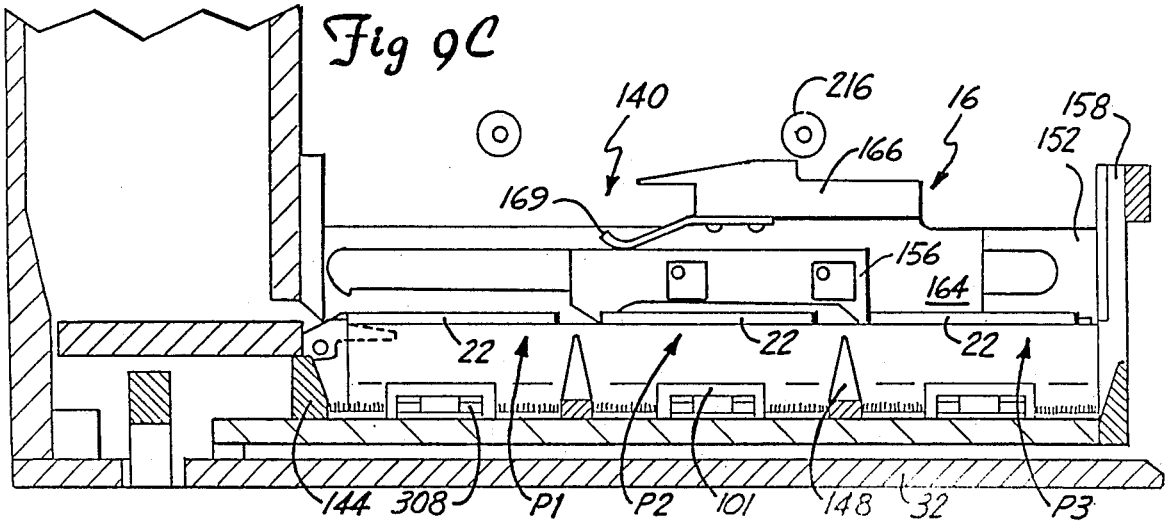
Figure 12C:
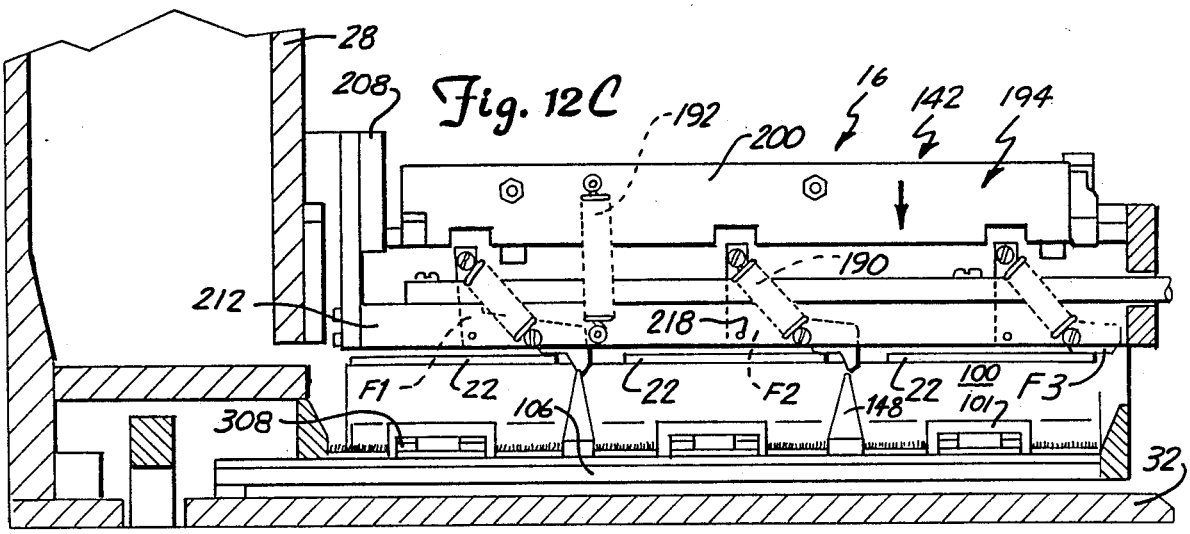

As can be seen from FIGS. 9C and 12C, the upper end of lever arms L of fingers F1–F3 will be positioned adjacent notches N1–N3 of actuator bar 194, thereby enabling the actuator bar to drop and release the three photograph slides 22, as soon as slide positioning mechanism 140 has moved the photograph slides 22 into positions P2 and P3 of staging area 94, and shuttle assembly 12 has moved one of photograph slides 22 into position P1. The left edge of pusher assembly delay surface 244 (i.e. that adjacent surface 242) will be immediately below cam roller 216 at this time. Main member 200 of actuator bar 194 will be allowed to drop only until cam roller 216 comes into contact with surface 244. Delay surface 244 is positioned at a height which is sufficient to permit gate release lever 128 to be disengaged from lip 126 of arm 118 when actuator bar 194 falls. However, delay surface 244 limits the downward motion of actuator bar 194 to such an extent that its pusher assembly actuating lever 129 does not engage microswitch lever 252 as long as roller 216 is riding on surface 244.

SLIDE PUSHER ASSEMBLY 14

Slide pusher assembly 14 can be described with reference to FIGS. 14–16. As shown, pusher assembly 14 includes push bar 290, driving arm 292, guide rod 294, guide rail 295, and push bar drive mechanism 296. Push bar 290 is formed by a plate member 298 having three pusher fingers 300, 302, and 304 extending in a forward direction therefrom. A forward end of pusher fingers 300, 302, and 304 includes slide engagement tabs 306 which extend above a thin, forwardly extending blade 308. Reset pin 299 is fastened to and extends from the right side of plate member 298.

Drive mechanism 296 is coupled to push bar 290 by driving arm 292. A forward end of arm 292 is fastened to plate member 298 of push bar 290 by screws 310. Guide and cam block 312 is mounted to a forward end of driving arm 292, while guide block 314 is mounted to a rearward end of the arm. Blocks 312 and 314 both include apertures through which guide rod 294 is fit. As shown in FIG. 14, guide member 316, which cooperates with guide rail 295, is mounted to the right side of plate 298. Guide rod 294 is fixedly mounted with respect to chassis base 32. Guide rail 295 is mounted to side wall 158. Push bar 290 is thereby guided along a linear path by guide rod 294 and guide rail 295 when driven by drive mechanism 296.

Drive mechanism 296 is mounted to chassis member 71 and includes motor 320, slotted bell crank 322, crank arm 324, and connecting arm 326. Motor 320 is mounted to chassis member 71 with its drive shaft 327 extending downward. Motor 320 also includes an associated gear reduction mechanism 321 which reduces the speed of drive shaft 326 to one rotation per cycle of pusher assembly 14. Crank arm 324 is connected to motor drive shaft 326, and has a roller pin 328 which fits within slot 330 of bell crank 322. A first end of bell crank 322 is pivotally connected to chassis member 71 by pivot assembly 332. Connecting rod 326 has its first end pivotally connected to a second end of bell crank 322 by pivot assembly 334. A second end of connecting rod 326 is pivotally connected to guide block 314 by pivot assembly 336.

Crank arm 324, bell crank 322, and connecting arm 326 convert the rotary motion of motor drive shaft 327 to cyclic, linear, reciprocal motion of push bar 290. When slide pusher assembly 14 is actuated, crank arm 324 will be rotated three hundred and sixty degrees. During the initial part of this rotational cycle (approximately two hundred and thirty degrees) push block 290 is driven forwardly from a retracted position to an extended position. For the remaining portion of this rotational cycle push bar 290 is driven rearwardly from its extended position to its retracted position. Due to the configuration of drive mechanism 296, and since crank arm 324 is rotated at a constant speed, push bar 290 is driven at a nonlinear speed and will be retracted faster than it is extended.

Figure 13:
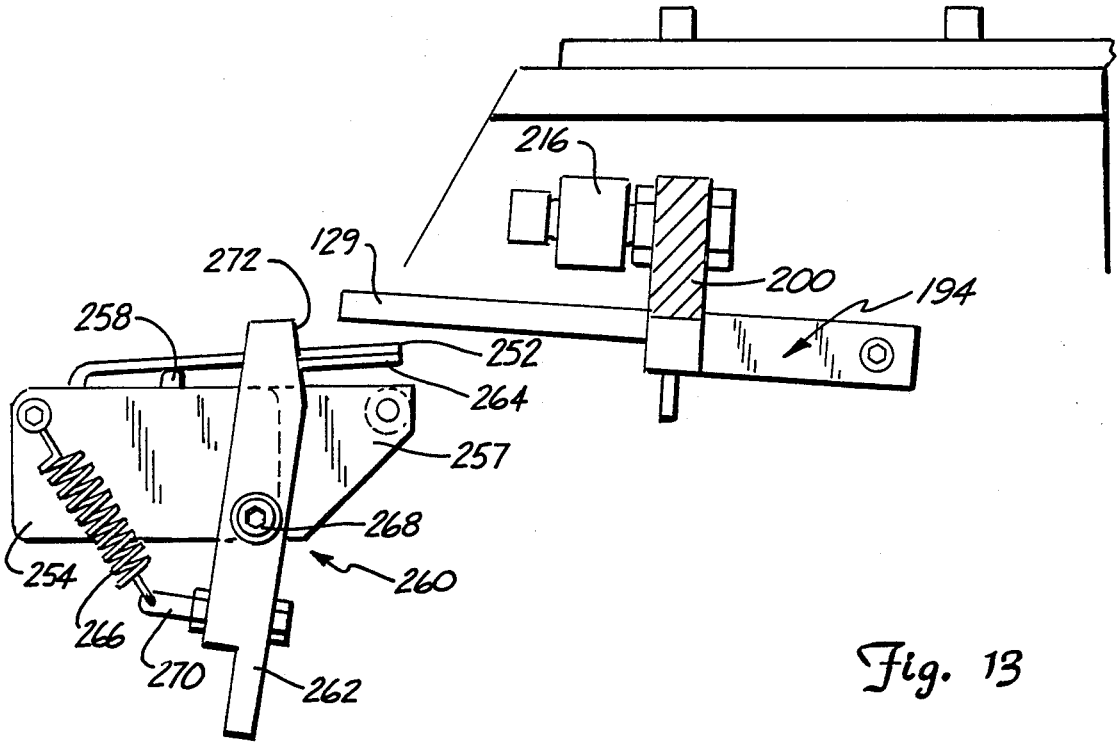
FIG. 13 is a fragmentary detailed view taken along lines 13—13 in FIG. 6 and illustrating the slide pusher actuating switch.

The reciprocal linear motion of push bar 290 is controlled by forward microswitch 254 and rear microswitch 256, both of which can be seen in FIG. 2. As shown in FIG. 7, forward microswitch 254 is mounted to bracket 257 adjacent pusher assembly actuating lever 129 of actuator bar 194. Bracket 257 is fixedly mounted with respect to chassis base 32. As perhaps best shown in FIGS. 7 and 13, microswitch 254 has an actuating pin 258 which is positioned beneath pivoting actuator lever 252. Actuating lever 252 extends underneath pusher assembly actuating lever 129.

A latch 260 formed by tension lever 262, retention lug 264 and spring 266 is associated with switch 254. Tension lever 262 is pivotally mounted to microswitch 254 by pivot assembly 268. Spring 266 has a first end mounted to microswitch 254, and a second end mounted to pin 270 which is secured to a lower end of lever 262. Lug 264 is mounted to a lower side of the forward end of lever 252, and extends in a leftward direction. Retention lug 264 is engaged by edge 272 on the upper forward side of lever 262. Forward microswitch 254 is a normally open switch.

Figures 14, 15, 16:
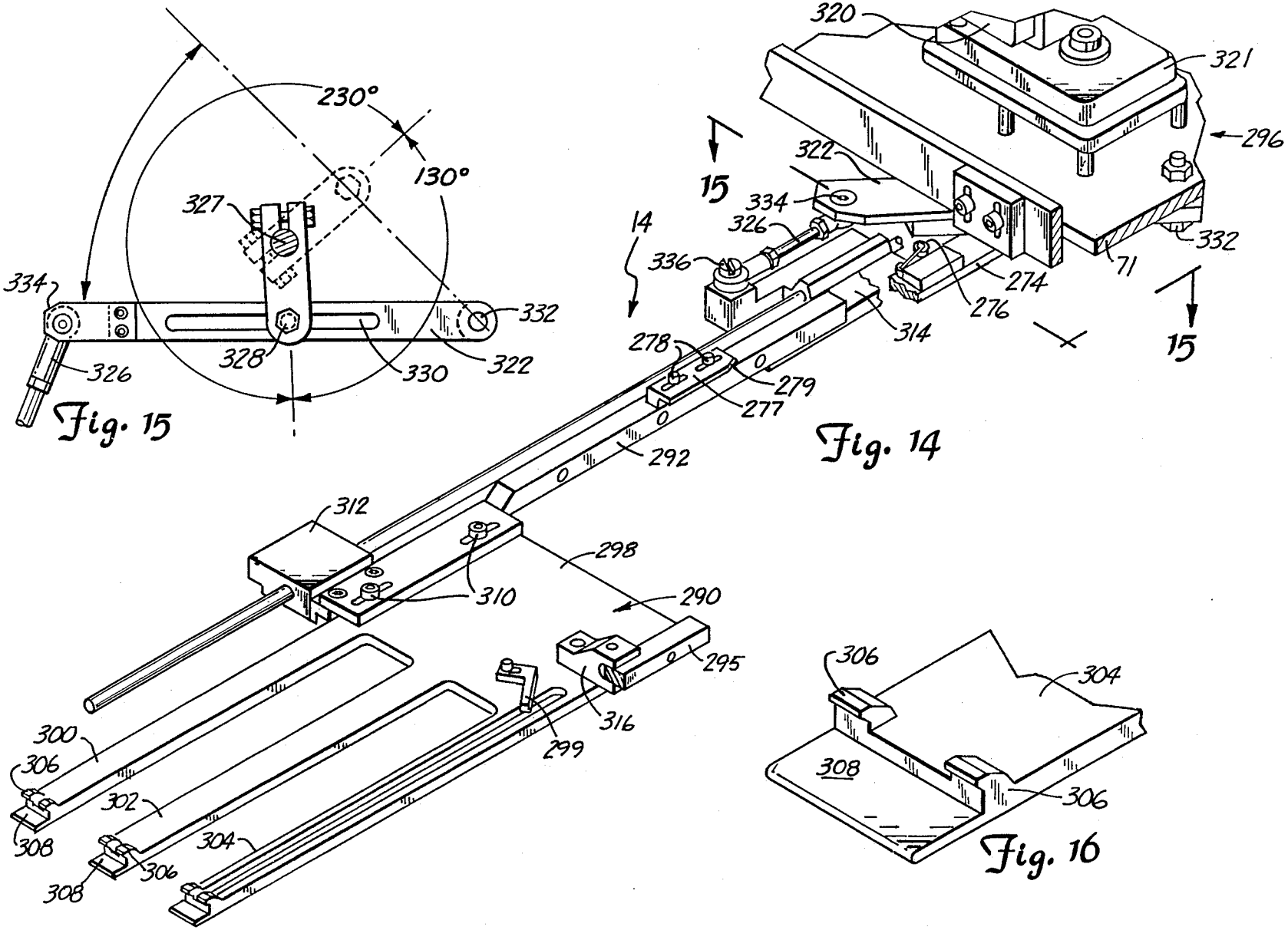
FIG. 14 is a detailed perspective view of the slide pusher assembly.
FIG. 15 is a sectional view taken along lines 15—15 in FIG. 14 and illustrating the push bar drive mechanism.
FIG. 16 is a detailed view of the tabs on an end of one of the fingers of the slide pusher assembly.
Figure 17:
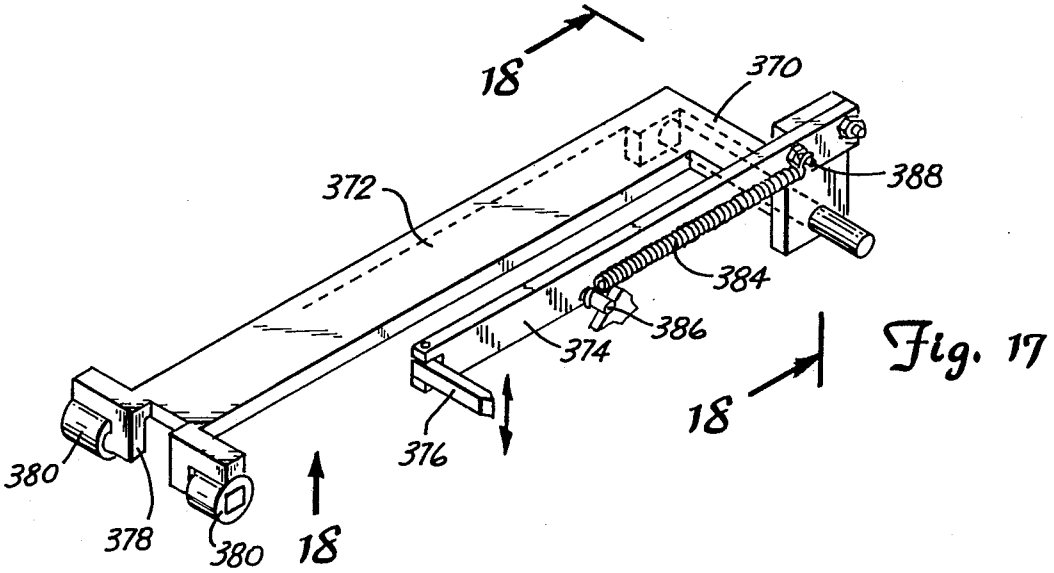
FIG. 17 is a detailed perspective view of the drag brake.
Figure 18:
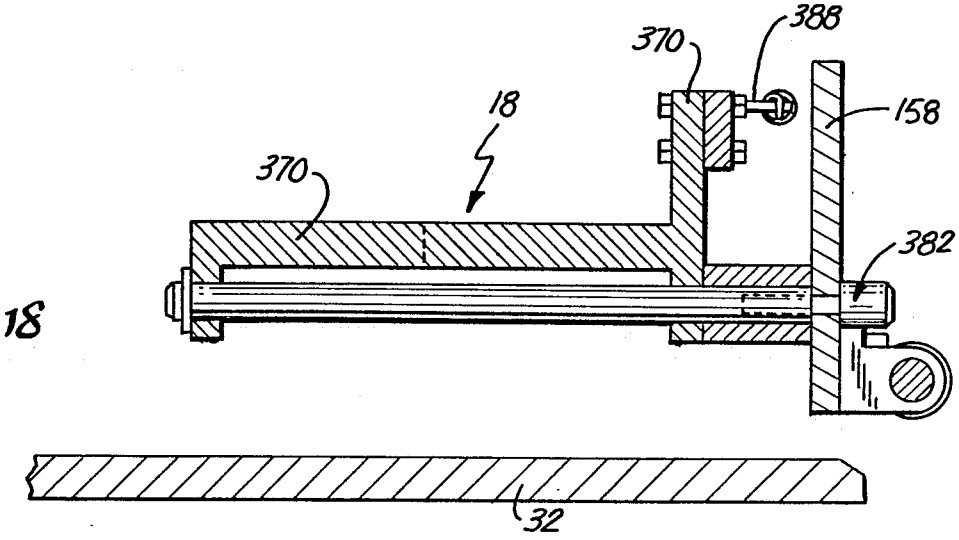
FIG. 18 is a sectional view taken along lines 18—18 in FIG. 17.

As shown in FIG. 14, rear microswitch 256 is mounted to bracket 274 adjacent chassis member 71. Microswitch 256 is a normally closed switch which includes actuating lever 276. Rear microswitch trip bar 277 is adjustably mounted to driving arm 292 by set screws 278. Trip bar 277 has an edge 279 which is adapted to engage a roller on an end of microswitch lever 276 as push bar 290 is driven back and forth.

Microswitches 254 and 256 are connected in a parallel electric circuit to drive motor 320. When push bar 290 is in its fully retracted position, trip bar 277 is engaged with actuating lever 276 forcing rear microswitch 256 to be in its actuated or OFF position. After gate 100 has been released and photograph slides 22 dropped to insertion area 134, moving member 154 of slide positioning mechanism 140 will continue moving to the left as shuttle arm 34 is retracted. As discussed above, for the portion of this motion during which cam roller 216 is riding on pusher assembly delay surface 244, main member 200 of actuator bar 194 is prevented from dropping to the full extent permitted by notches N1–N3. Pusher assembly actuating lever 129 of actuator bar 194 is therefore not in contact with actuating lever 252 of microswitch 254. Forward microswitch 254 is therefore unactuated and in its OFF position, disabling motor 320. As moving member 154 continues to be driven to the left during the retraction stroke of shuttle arm 34, roller 216 will meet the rightmost edge of delay surface 244. After further motion of member 154 in the left direction, roller 216 will fall off and below delay surface 244, permitting actuator bar 194 to drop to its fullest extent at which the ends of lever arms L of fingers F1–F3 engage notches N1–N3, respectively. With this additional downward motion of actuator bar 194, its pusher assembly actuating lever 129 will engage microswitch actuating lever 252, thereby switching forward microswitch 254 to its ON position. Lever 252 is held downward by edge 272 of lever 262 which is engaged with retention lug 264.

With forward microswitch 254 switched ON in this manner, drive motor 320 begins its rotation and drives push bar 290 in a forward direction from its retracted position. After driving arm 292 travels through a short portion of its forward stroke of motion, trip bar 277 will be disengaged from lever 276 of rear microswitch 256. Rear microswitch 256 is then switched to its ON position. Motor 320 will continue to rotate with both forward microswitch 254 and rear microswitch 56 switched to their ON positions. With continued motion of moving member 154 to the left following the actuation of slide pusher assembly 14, ramping reset surface 240 will engage cam roller 214 and raise actuator bar 194. When bar 194 is raised high enough that the lower edges of notches N1–N3 are beyond lever arms L of fingers F1–F3, springs 190 will rotate the fingers until the lever arms engage stops 222, 224 and 226, respectively. Actuator bar 194 is thereby supported in its raised position, and counting mechanism 142 ia reset.

As the motion of push bar 290 continues and it approaches its extended position, reset pin 299 will engage a lower edge of tension lever 262 and release actuating lever 252 of microswitch 254. Microswitch 254 is thereby returned to its normally open or OFF position. However, since rear microswitch 256 is still switched ON, motor 320 continues to drive push bar 290 through its range of reciprocal linear motion. After push bar 290 reaches its extended position, drive mechanism 296 causes the push bar to be driven in a rearward direction toward its retracted position. As the push bar approaches its retracted position, edge 279 of trip bar 277 will engage rear microswitch actuating lever 276, causing the rear microswitch 256 to be switched OFF. The position of trip bar 277 on driving arm 292 is adjusted by means of set screws 278 such that push bar 290 is in its fully retracted position when microswitch 256 is switched OFF.

DRAG BRAKE 18

Drag brake 18 can be described with reference to FIGS. 1–2, and 17–18. Drag brake 18 includes base 370, main arm 372, release arm 374, and release lever 376. Main arm 372 extends in a forward direction from base 370 and has a bifurcated end 378. Friction elements 380, which are sections of plastic tubing in one embodiment, are mounted to the lower sides of the bifurcated portions of end 378. Release arm 374 also extends in a forward direction from base 370, and is generally parallel to main arm 372. Release lever 376 is pivotally mounted to a forward end of release arm 374, and extends in a generally perpendicular direction from the release arm.

Drag brake 18 is pivotally mounted to chassis side wall 158 behind insertion assembly 16 by means of pivot assembly 382. Bias spring 384 is stretched between pin 386 which is mounted to the inside of chassis side wall 158, and pin 388 which is mounted to drag brake base 370. Spring 384, and the force of gravity acting on main arm 372, cause friction elements 380 to apply a drag force to slide sleeving material 26 passing through sleever 10. This drag force keeps sleeving material 26 tight as it is being fed into slide insertion assembly 16. As shown in FIG. 1, release lever 376 extends through an opening in chassis side wall 158. This opening is formed by a horizontally extending portion 390, and a vertically extending portion 392. Friction elements 380 can be lowered into communication with sleeving material 26 and thereby perform their function when lever arm 376 is positioned within vertically extending slot portion 392. Drag brake 18 can be raised by lifting lever arm 376, and held in an upright position by pivoting the lever arm in a rearward direction into horizontally extending portion 390. Drag brake 18 is typically raised in this manner to facilitate the insertion of sleeving material 26 in slide sleever 10.

SLEEVE CLAMP 20

Figure 20:
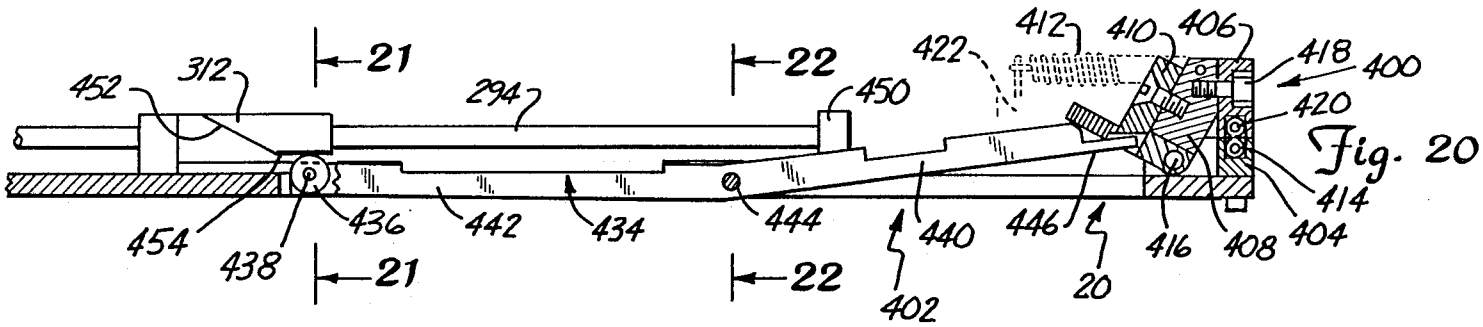
FIG. 20 is a sectional view taken along lines 20—20 in FIG. 19 and illustrating the sleeve clamping mechanism and actuator.
Figure 22:
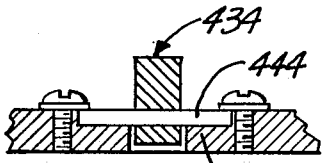
FIG. 22 is a detailed sectional view taken along lines 22—22 in FIG. 20 and illustrating the sleeve clamp actuator pivot.

Sleeve clamp 20 can be described with reference to FIGS. 19–22. Sleeve clamp 20 is positioned in front of and on the left side of insertion assembly 16, and is formed by clamping mechanism 400 and actuating mechanism 402. Clamping mechanism 400 includes lower clamp bar 404, upper clamp bar 406, pivotal mount 408, release lever 410, and spring 412. Lower clamp bar 404 is fixedly mounted to chassis base 32 and has a friction element 414 (such as plastic tube) extending along the entire length of its upper edge. Mount 408 is pivotally mounted to chassis base 32 by means of pivot pin 416. Upper clamp bar 406 is movably fastened to mount 408 by set screws 418. A friction member 420 is mounted to and extends along the entire lower edge of upper clamp bar 406. When mount 408 and upper clamp bar 406 are rotated to their forwardmost position, friction elements 414 and 420 will be in contact with one another as shown in FIG. 20. A small amount of movement or float between clamp bar 406 and mount 408 facilitates even clamping forces along friction elements 414 and 420. Release lever 410 is pivotally mounted to a rear side of pivotal mount 408. Mount 408 is biased toward an open position (i.e. with friction element 420 rotated backwards and out of physical contact with friction element 404) by spring 412. As shown, spring 412 has a first end coupled to mechanism 408, and a second end mounted with respect to chassis base 32 through mounting bracket 422.

Sleeve clamp actuating mechanism 402 includes guide and cam block 312, guide rod 294, lever arm 434, and cam roller 436. Lever arm 434 is formed by a forward section 440 and a rearward section 442 which are inclined with respect to one another. A central portion of lever arm 434 is mounted to an edge of chassis base 32 by pivot assembly 444. Cam roller 436 is rotatably mounted to the rearward end of lever arm rearward section 442 by pivot assembly 438. A forward end of lever arm forward section 440 is adapted to engage the bottom edge of release lever 410.

Guide rod 294 is mounted to chassis base 32 adjacent lever arm 434 by brackets such as 450. Guide and cam block 12 is mounted to guide rod 294 and to plate member 298 of push bar 290. Block 312 will therefore be reciprocally driven about a linear path with slide pusher assembly 14. Guide and cam block 312 has a sloping cam surface 452 and a bottom edge surface 454 which underlie portions of the block and are positioned to engage cam roller 436. Surface 452 slopes downward in a forward direction from an upper rear surface of block 312. Surface 454 is a horizontally oriented surface which extends to the forward end of block 312 from an intersection with surface 454.

As shown in FIG. 14, guide and cam block 312 is mounted to plate member 298 of push bar 290. The relative position of guide and cam block 312 with respect to tabs 306 of fingers 300, 302, and 304 can be adjusted by loosening screws 310 and moving push bar 290 with respect to the guide and cam block before retightening the screws. The opening and closing of sleeve clamp 20 can thereby be coordinated with the position of push bar 290 along its path of movement When bottom edge surface 454 of guide and cam block 312 is in contact with cam roller 436, rear section 442 of lever arm 434 is forced downward while front section 440 is forced upward. End 446 of lever arm 434 thereby engages lever 410 of sleeve clamp 20, and forces upper clamp bar 406 to rotate into engagement with lower clamp bar 404. As guide and cam block 312 is moved forward with push bar 290, cam roller 436 will contact sloping surface 452. Arm 434 thereby rotates in a clockwise direction (as seen from the left in FIG. 20), lowering its end 446.

Sleeve clamp 20 is then opened as upper clamp bar 406 is rotated backwards under the force of spring 412. Sleeve clamp 20 can also be manually opened by rotating release lever 410 and disengaging its lower surface from end 446 of arm 434. The end of a new roll of slide sleeving material 26 can be fed through clamp 20 when it is manually opened in this manner.

POCKET OPENING SUBASSEMBLY 90

Slide sleeve pocket opening subassembly 90 can be described with reference to FIGS. 1–2, 6–7 and 23–28. Pocket opening subassembly 90 is formed by an undriven or stationary portion 500 and a driven or moving portion 502. Stationary portion 500 includes a plurality of elongated lug members such as set screws 504 and elongated resilient biasing means such as springs 506 which extend in an upwardly and rearwardly direction from pivotal mount 408 of sleeve clamp 20. Screws 504 and springs 506 therefore move along with upper clamp bar 406 as clamp 20 is opened and closed. The embodiment shown includes three set screws 504, one of which is aligned with the center of each slide position P1–P3. A spring 506 is positioned between the slide insertion positions P1 and P2, between positions P2 and P3, on the right side of position P3 and on the left side of position P1. In the embodiment shown, screws 504 and springs 506 extend from mount 408 at an angle of approximately thirty degrees when sleeve clamp 20 is closed. Springs 506 extend a greater distance from mount 408 than screws 504.

As perhaps best shown in FIG. 6, slide sleeving material 26 is passed along sleever 10 just above chassis base 32 and below slide insertion assembly 16. At the position where it travels underneath slide insertion assembly 16, sleeving material 26 passes below chassis member 106 and insertion area 134. Chassis base 32 has a raised lip 510 at a location just below moving portion 502 of pocket opening subassembly 90. Slide sleeving 26 is thereby directed upward by lip 510, and passes over stationary portion 500 of pocket opening subassembly 90. Stationary portion 500 supports sleeving material 26 above chassis base 32 at a height slightly higher than insertion area 134. Set screws 504 and springs 506 are positioned in such a manner as to bow slide 15 sleeving material 26 in a downwardly opening concave arc before it passes through sleeve clamp 20. As shown in FIG. 6, the bow caused by stationary portion 500 causes pocket opening slots 30 of pockets 24 to open at a location immediately in front of moving portion 502 and above stationary portion 500 of slide insertion subassembly 90.

The combination of raised lip 510 and adjacent portion of chassis member 106 support portions of sleeving material 26 adjacent pocket opening slots 30 at a first height above chassis base 32 which is below the height of the ends of screws 504 and springs 506. Sleeve clamp 20 also supports portions of sleeving material 26 opposite pockets 24 from slots 30 at a height below the ends of screws 504 and springs 506. This relative positioning of the ends of pockets 24 and springs 506 and screws 504 facilitates the arcing of sleeving material 26.

Figure 21:
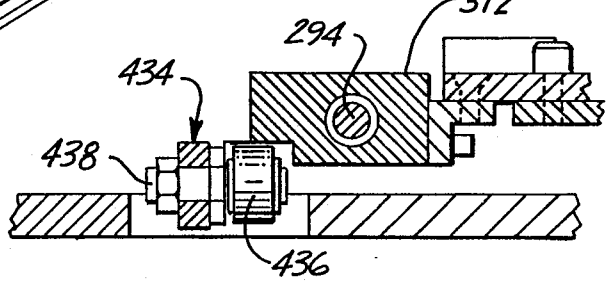
FIG. 21 is a detailed sectional view taken along lines 21—21 in FIG. 20 and illustrating the sleeve clamp actuating mechanism.
Figure 19:
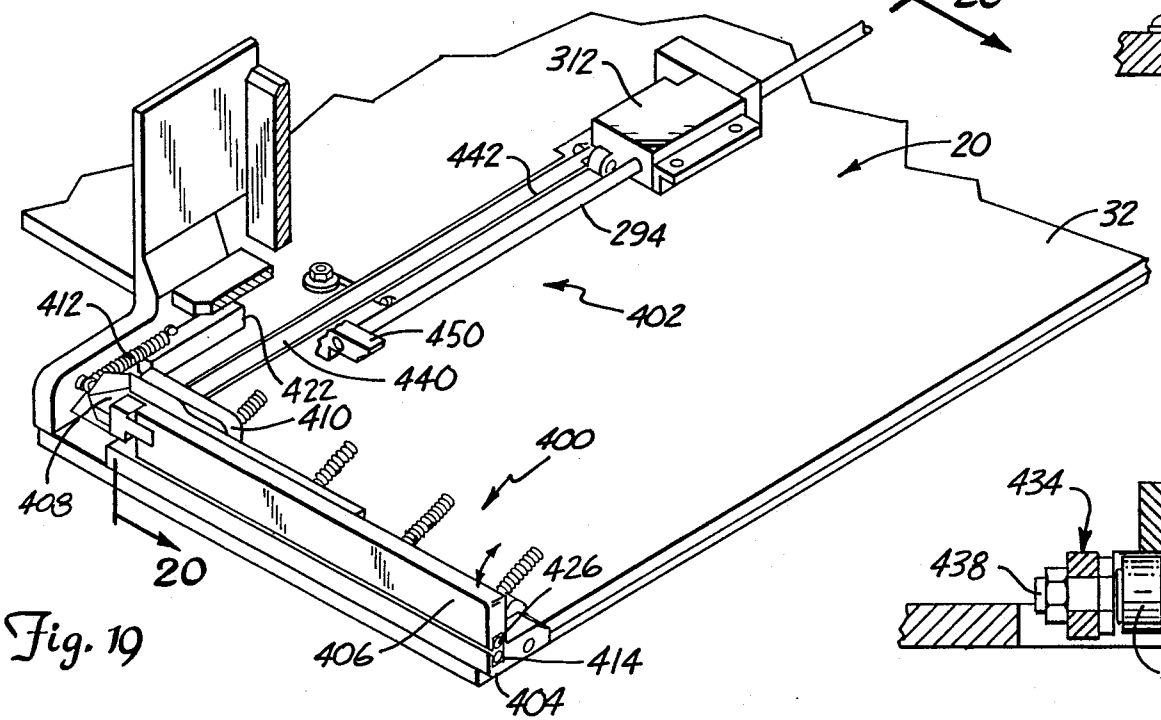
FIG. 19 is a detailed perspective view of the sleeve/-clamping mechanism and actuator.
Figure 23:
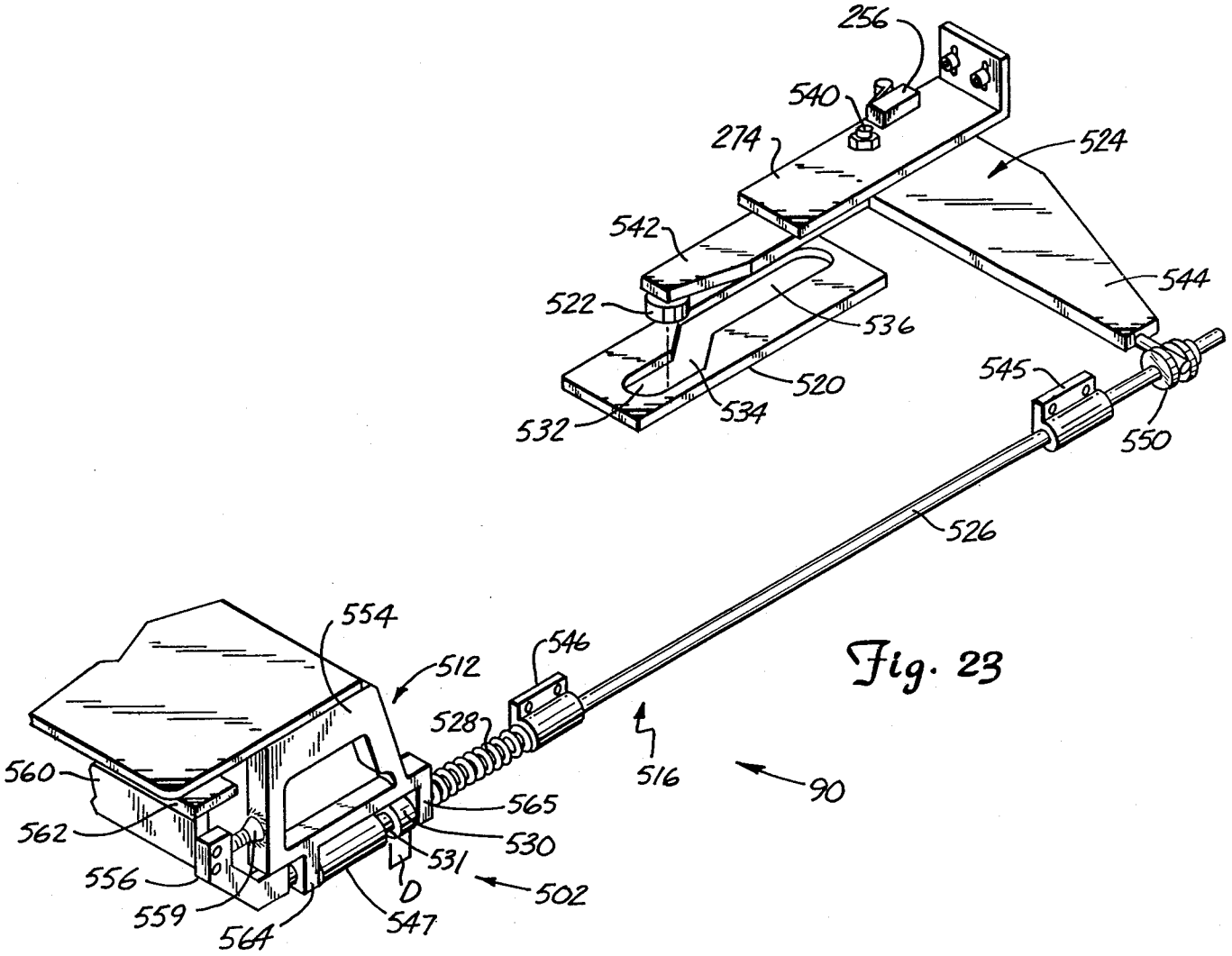
FIG. 23 is a detailed perspective view of the actuating mechanism for the slide sleeve pocket opening subassembly.

Moving portion 502 of pocket opening subassembly 90 includes a frame 512, pocket opening fingers 514, and actuating mechanism 516. Actuating mechanism 516 includes cam 520, cam follower 522, bell crank 524, push rod 526, spring 528, spacers stops 530, arm 556, cam support bars 560 and 562, and finger opening cams 578. As shown in FIG. 21, cam 520 is mounted to driving arm 292 of slide pusher assembly 14, and has three slot sections 532, 534, and 536. Slot section 532 extends in a rearward direction from the forward end of cam 520. Slot section 534 extends rearwardly and to the left from the rearward end of slot section 532. Slot section 536 extends in a rearward direction from the rearward end of slot section 534.

Bell crank 524 is pivotally mounted to a lower side of bracket 274 by pivot assembly 540, and has a camming arm 542 and a crank arm 544. Cam follower 522 is rotatably mounted to a bottom surface of bell crank camming arm 542, and rides within slot sections 532, 534, and 536 of cam 520. Rod 526 is slidably mounted to chassis side wall 158 by means of bushings 545, 546 and 547. An end of bell crank arm 544 has a rod 548 extending therefrom. A clamp 550 is fixedly mounted to push rod 526 and engages rod 448. Cam follower 522 will follow slot sections 532, 534 and 536 as cam 520 is reciprocally driven forward and rearward with driving arm 292 of pusher assembly 14. Bell crank 524 will therefore rock back and forth, transferring the linear motion of arm driving 292 to reciprocating linear motion of push rod 526.

Frame 512 includes side member 554 and finger mounting bar 558. Side member 554 has front and rear legs 564 and 565, respectively, which are slidably mounted to push rod 526 adjacent chassis side wall 158.

Legs 564 and 565 are located on opposite sides of bushing 547. Spacer 530 is slidably mounted to push rod 526 between frame leg 565 and bushing 547. When frame leg 564 is in contact with bushing 547 and spacer 530 is in contact with leg 565 there is a gap 531 of distance D between bushing 547 and spacer 530. Spring 258 surrounds push rod 526 and is compressed between frame leg 565 and bushing 546.

Finger mounting bar 558 is fixedly mounted to frame member 554, and extends from the frame member in a generally perpendicular direction across all three slide positions P1–P3. Arm 556 is mounted to an end of push rod 526 opposite clamp 550, and extends upwardly in front of frame member 554. Cam support bar 560 is fixedly mounted to arm 556 and extends across the front of sleever 10 in a generally parallel orientation to finger mounting bar 558. Cam support bar 562 is secured to an upper edge of bar 560, and is also generally parallel to finger mounting bar 558. Spacing between frame members 554 and arm 556 can be adjusted by screw 559.

A pair of pocket opening fingers 514 is pivotally fastened to finger mounting bar 558 by pivot pins 566 adjacent each slide position. Each finger 514 has a pocket engaging tab 568 which extends in a generally forward direction, and a slide receiving slot 570 below the tab. The lower edge of each slot 570 is defined by a horizontally extending lip 571, while the upper edge is defined by tab 568. Each finger 514 has a roller pin 572 which extends upward from its top surface at a location in front of its corresponding pivot pin 566. Roller pins 572 of each pair of fingers 514 are coupled together by a spring 574. Springs 574 force together the pair of fingers 514 at each slide position P1–P3, and cause their corresponding pocket engaging tabs 568 to meet in the center of the slide position and to form a forwardly extending and rounded tip.

Finger opening cams 578 are mounted to an upper surface of support bar 562 and extend between roller pins 572 of the pair of fingers 514 at each slide position P1–P3. Fasteners such as bolts 580 hold cams 578 onto mounting bar 562. Cams 578 have a pair of opposed and diverging camming surfaces 582 which extend outwardly and to the rear from a central portion of each slide position P1–P3. Roller pins 572 of fingers 514 are positioned adjacent to and ride on camming surfaces 582. At their forwardmost portions, opposed camming surfaces 582 of each cam 578 are spaced from one another by a distance which permits spring 574 to fully close the corresponding fingers 514, and form the rounded edge with their tabs 568. Camming surfaces 582 on each cam 578 extend farther away from one another in a rearward direction. The rearward portions of opposed camming surfaces 582 of each cam 578 are spaced far enough apart to force corresponding pairs of fingers 514 to rotate apart to an open position. When fingers 514 are in their open position, photograph slides 22 can pass between them through slots 570.

Figure 27:
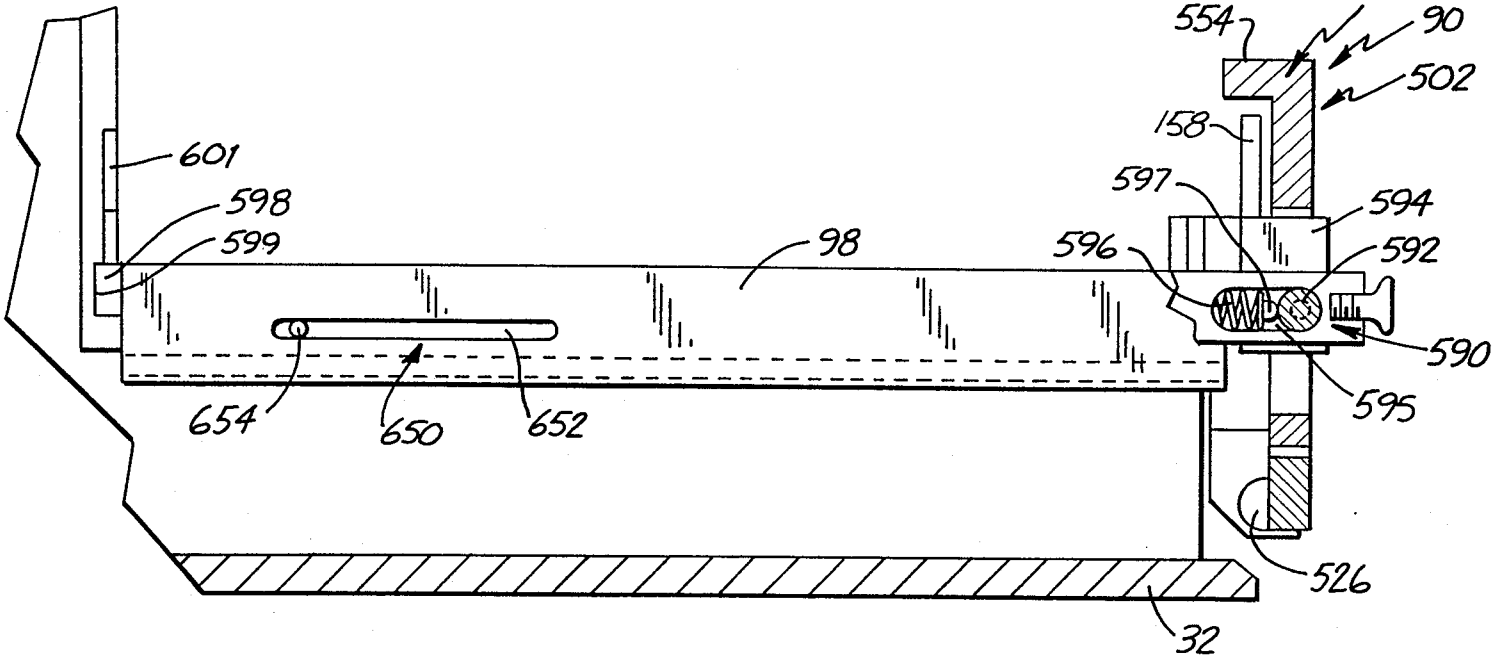
FIG. 27 is a detailed sectional view illustrating the pivot assembly for the moving portion of the pocket opening subassembly.
Figure 28:
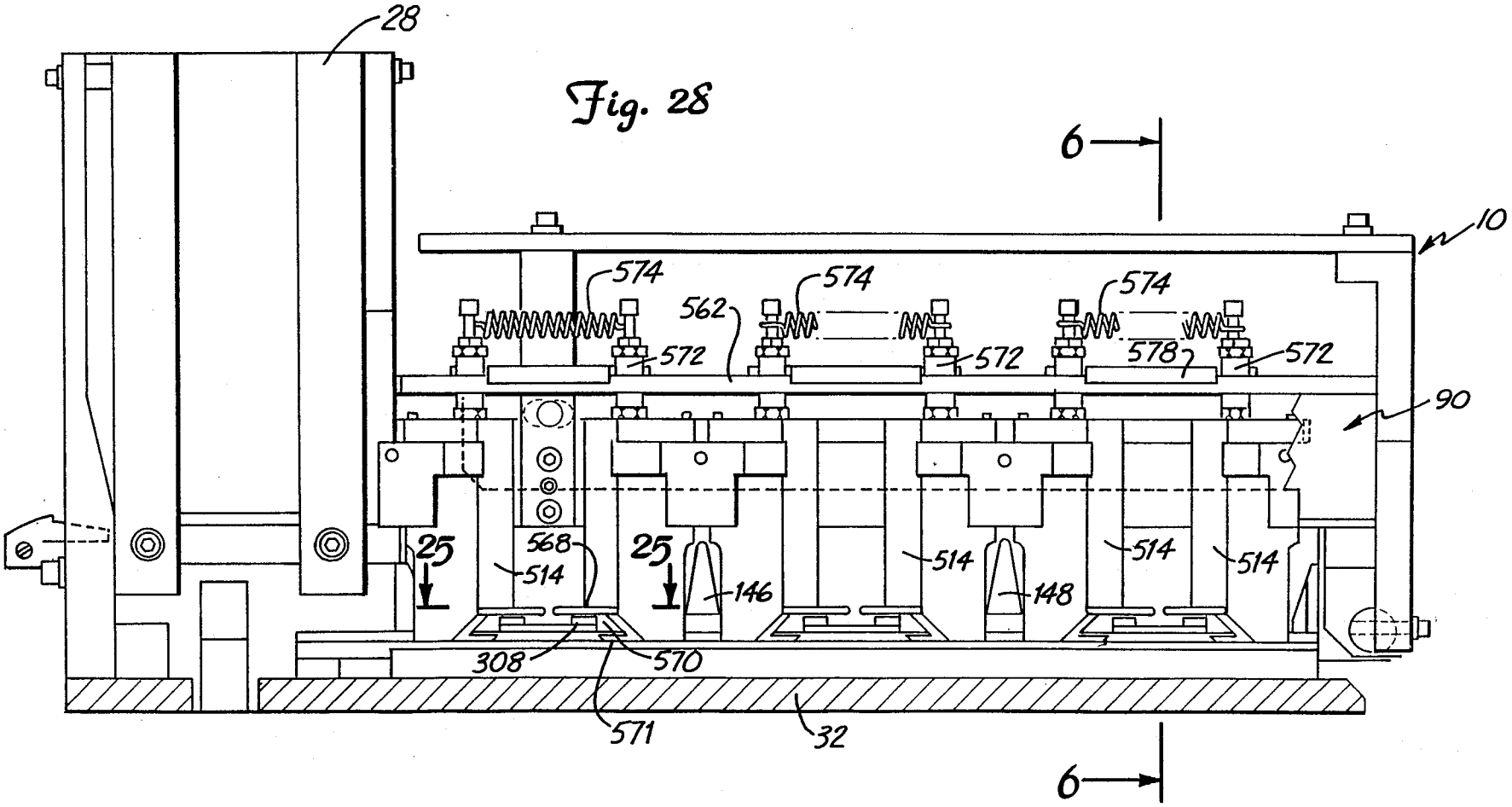
FIG. 28 is a front view of the slide insertion assembly.

Frame 512 and arm 556 are pivotally mounted to rod 526. Moving portion 502 of pocket opening subassembly 90 can therefore be swung upward and away from slide indexing subassembly 88 to clear jams which may occur from time to time. Frame 512 and arm 556 rotate about an axis concentric with push rod 526. As shown in FIG. 27, guide bar 98 also pivots upward with frame 512, and is pivotally mounted to a forward end of chassis side wall 158 by pivot mechanism 590. Pivot mechanism 590 includes a pivot pin 592 which extends forward from bracket 594 which is mounted to a forward end of chassis side wall 158. The right edge of guide bar 98 has an elongated slot 595 through which pivot pin 592 extends. A spring 596 mounted within slot 595 forces a ball 597 into engagement with pivot pin 592 to releasably secure guide bar 98 to the pivot pin. The end of guide bar 98 opposite pivot mechanism 290 has a lug 598 extending therefrom. Lug 598 is releasably forced into notch 599 of right hopper wall 29 to secure guide bar 98 in its operative position. When guide bar is raised and lowered, lug 599 is guided to and from notch 599 by vertically oriented guide track 601 in hopper wall 29.

Since guide bar 98 is rotated upward along with moving portion 502 of pocket opening subassembly 90, but rotates about a pivot axis which is vertically displaced from that of the moving portion of the pocket opening subassembly, the guide bar is coupled to the moving portion by slide linkage 650. Slide linkage 650 includes elongated slot 652 and pin 654 which extends into the slot from the back side of finger mounting bar 558. Guide bar 98 is therefore raised and lowered, along with moving portion 502 of pocket opening assembly 90, by pin 654 which slides within slot 652.

After arm 292 and push block 290 have reached their fully extended position, they will be retracted in the manner described above. Sleeve clamp 20 is thereby closed, and fingers 300, 302, and 304 fully retracted. Rod 526 is thereby driven in reverse direction by bell crank 524 as cam follower 522 rides within cam 520, thereby causing pairs of fingers 514 to close, and frame 512 to retract the fingers. This previous motion will have positioned an adjacent row of sleeve pockets 24 adjacent slide insertion assembly 16, with their pocket opening slots 30 being positioned adjacent fingers 514 and opened by pocket opening mechanism 500. All of the above procedures are thereby set to be repeated. The relative timing between the opening and closing of sleeve clamp 20, and the operation of frame 512, can be adjusted by the positioning of cam block 312 and cam 520 on arm 292.

END OF SLEEVING MATERIAL SHUT-OFF MECHANISM 600

Figure 29:
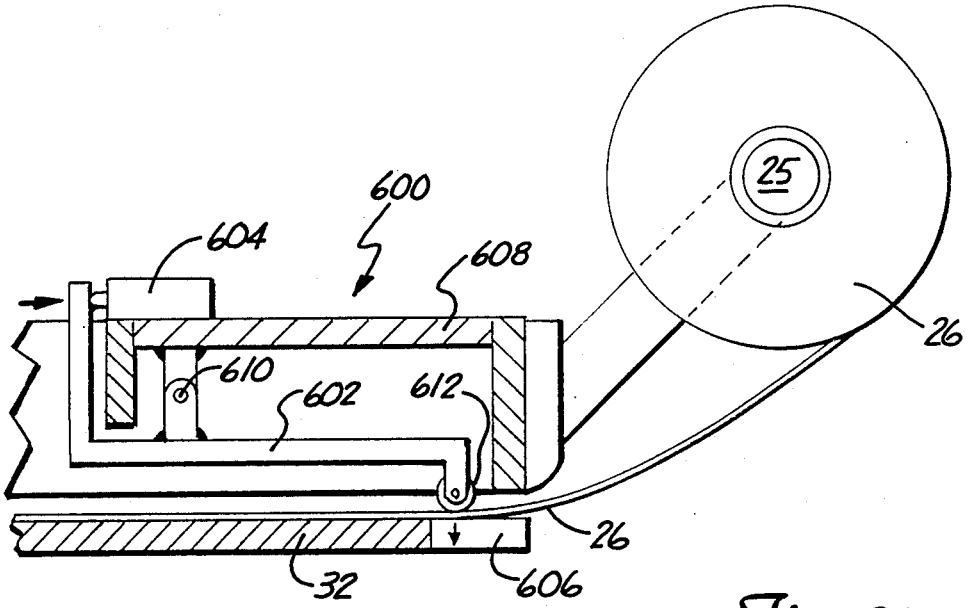
FIG. 29 is a detailed sectional view illustrating the end of sleeving material shut-off mechanism.

As shown in FIG. 29, slide sleeving system 10 also includes an automatic end of sleeving material shut-off mechanism 600. Mechanism 600 includes sensor arm 602, microswitch 604, and an opening 606 within chassis base 32. Arm 602 is pivotally suspended from chassis member 608 by pivot pin 610. A lower end of arm 602 has a roller 612 rotatably mounted thereto immediately above opening 606. An end of arm 602 opposite pivot pin 610 from roller 612 is positioned adjacent microswitch 604. Microswitch 604 is a normally closed switch, and is coupled to shuttle assembly drive motor 70 and slide pusher assembly motor 320. While sleeving material 26 is passing between roller 612 and opening 606, arm 602 is prevented from pivoting (in the clockwise direction as seen in FIG. 29), and microswitch 604 will remain unactuated.

When the roll of sleeving material 26 is consumed, and the end passes by roller 612, the weight of arm 602 will cause the roller to fall into opening 606. Microswitch 604 will then be actuated by arm 602 and will turn off shuttle assembly drive motor 70 and slide pusher assembly motor 320.

OPERATION OF SLIDE SLEEVER 10

Slide sleever 10 is set up for operation by positioning a roll of slide sleeving material 26 on spool 25. The roll is oriented in a manner which places pocket opening slots 30 upward and toward the rear as sleeving material 26 is fed through sleever 10. Release lever 376 is actuated to raise drag brake 18, moving portion 502 of pocket opening subassembly 90 is rotated upward from remaining portions of slide insertion assembly 16, and release lever 410 is disengaged from lever arm 434 to open sleeve clamp 20. Sleeving material 26 is then fed through sleever 10 above chassis base 32 by passing the sleeving material below shutoff mechanism 600, drag brake 18, slide indexing subassembly 88, moving portion 502 of pocket opening subassembly 90, above stationary portion 500 of the pocket opening subassembly 90, and through sleeve clamp 20. After sleeving material 26 is properly aligned and positioned, drag brake 18 and moving portion 502 of pocket opening subassembly 90 are lowered, and sleeve clamp 20 closed. Photograph slides 22 are then positioned within hopper 28 in a first-in, first-out order.

Figures 24A, 24B, 24C:
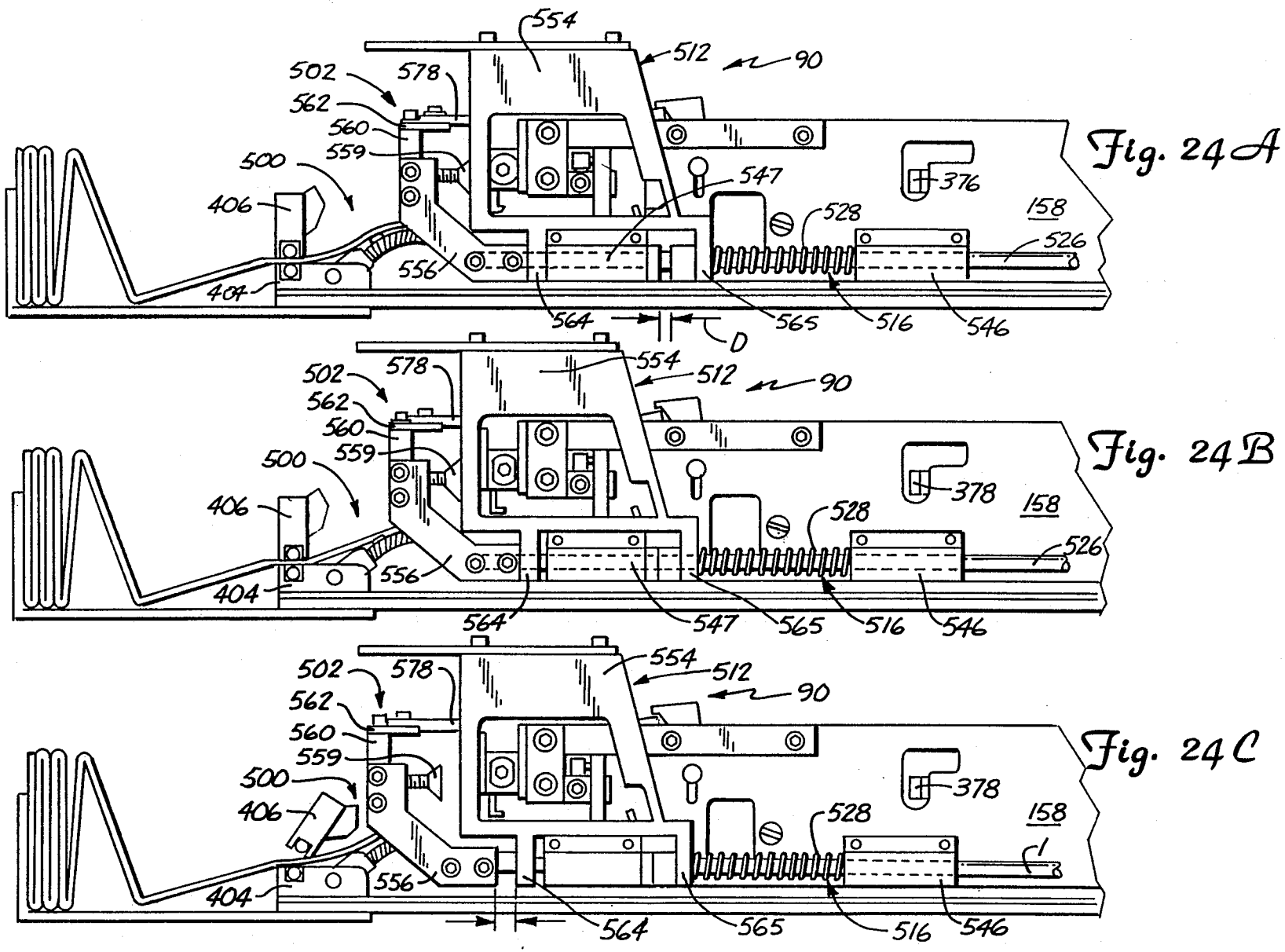
FIGS. 24A–24C are side views of the sleever illustrating the operation of the actuating mechanism for the slide sleeve pocket opening subassembly and sleeve clamp as photograph slides are being sleeved.
Figure 25C:
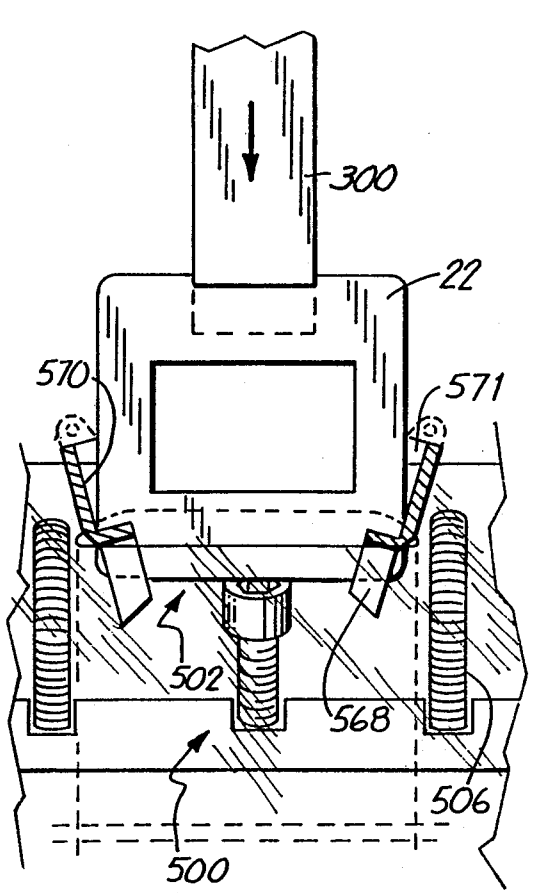
FIGS. 25A–25E are top views illustrating the operation of the pocket opening figures as photograph slides are inserted into the sleeving material.
Figure 25B:
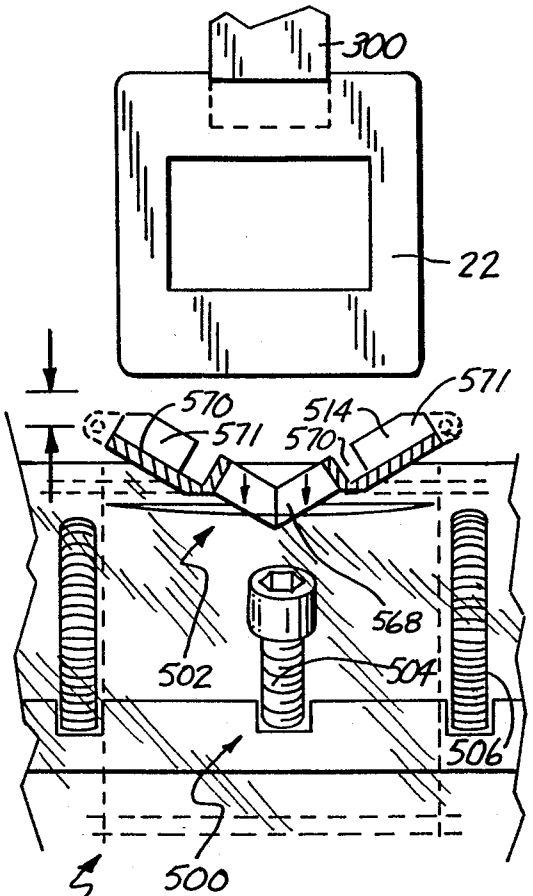
Figure 25A:
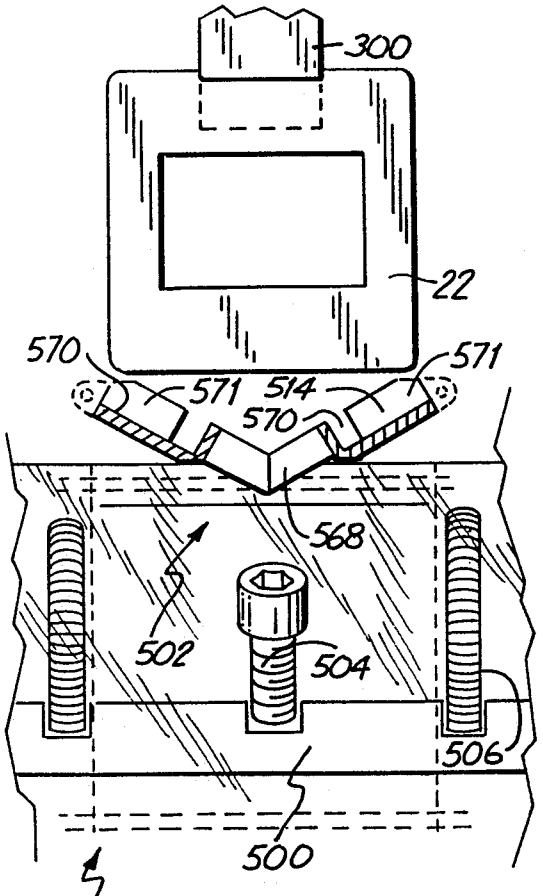
Figure 25D:
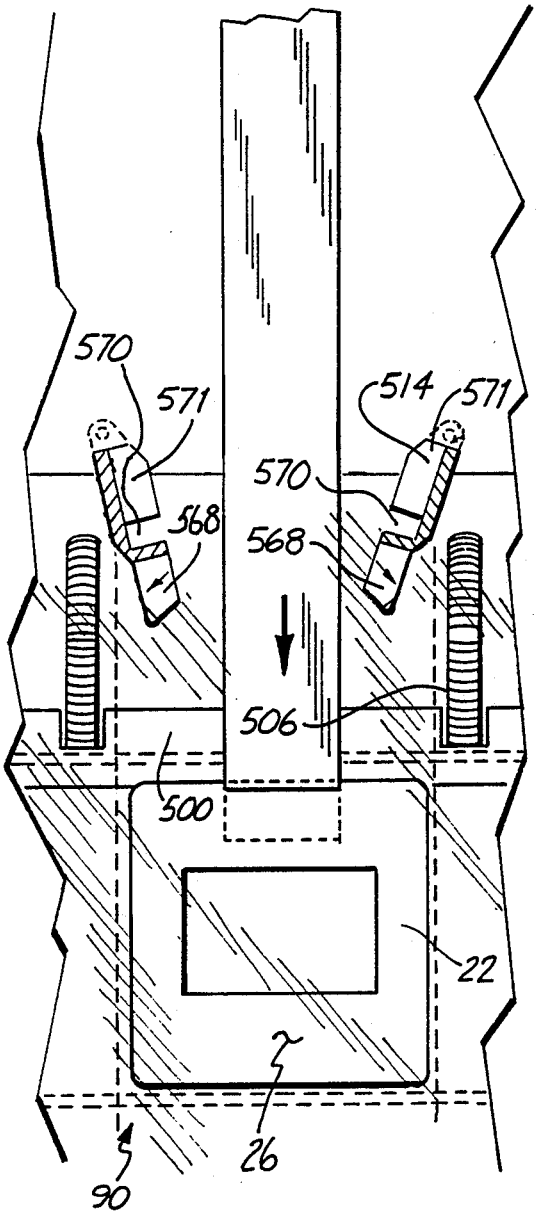
Figure 25E:
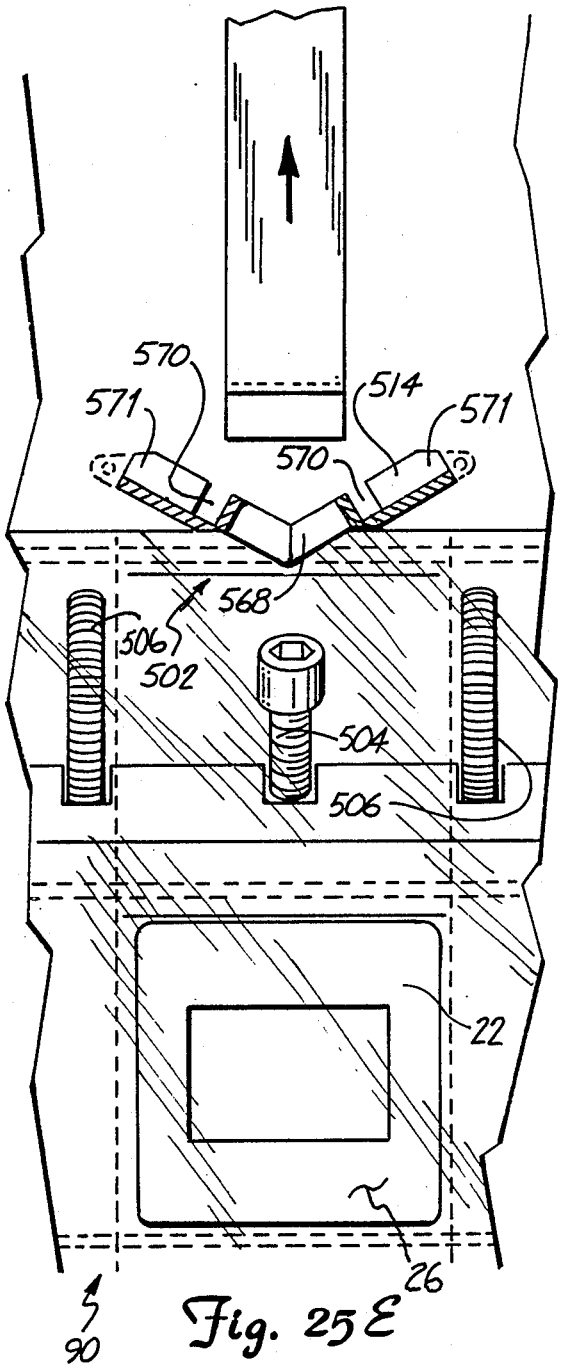
Figure 26A:
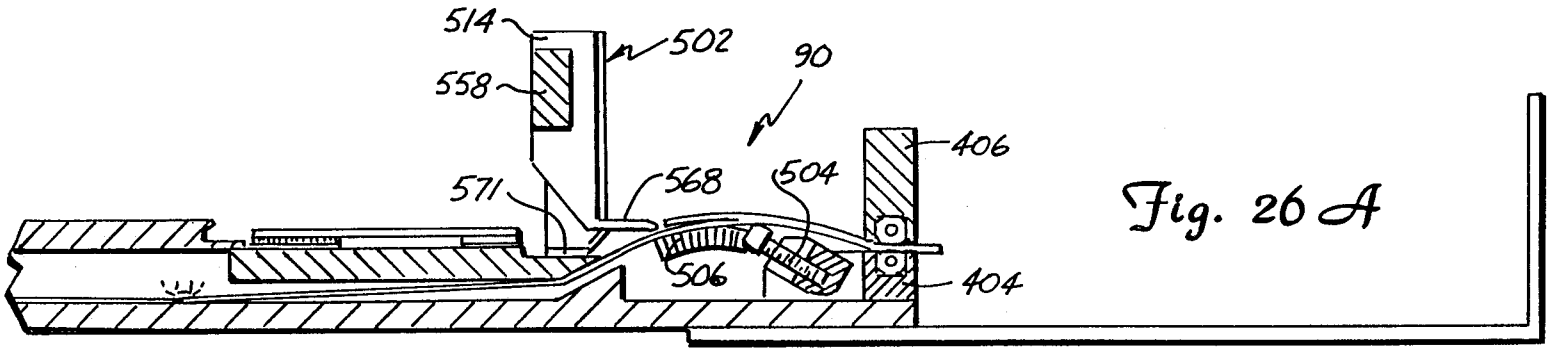
FIGS. 26A–26E are side views illustrating the operation of the pocket opening fingers and sleeve clamp while photograph slides are being inserted into the sleeving material.

The sleeving of photograph slides 22 is initiated following the actuation of a switch (not shown) on the rear of sleever 10. Slide shuttle assembly 12 is thereby actuated and begins sliding photograph slides 22, one at a time, from hopper 28 into staging area 94 of slide insertion assembly 16. After three photograph slides 22 have been moved to positions P1–P3, and dropped to insertion area 134, slide insertion assembly 16 is actuated. During the initial part of the stroke of slide insertion assembly 16, push bar 290 is driven forward and cam follower 522 of moving portion 502 of pocket opening subassembly 90 will ride within slot section 532 of cam 520. Bell rank 524 will therefore remain unactuated, and frame 512 of moving portion 502 of pocket opening subassembly 90 will remain stationary. Bottom edge surface 454 of guide and cam block 312 is engaged with cam roller 436 during this time, closing sleeve clamp 20. Various portions of sleever 10 during this time frame are illustrated in FIGS. 24A, 25A and 26A.

Figure 26B:
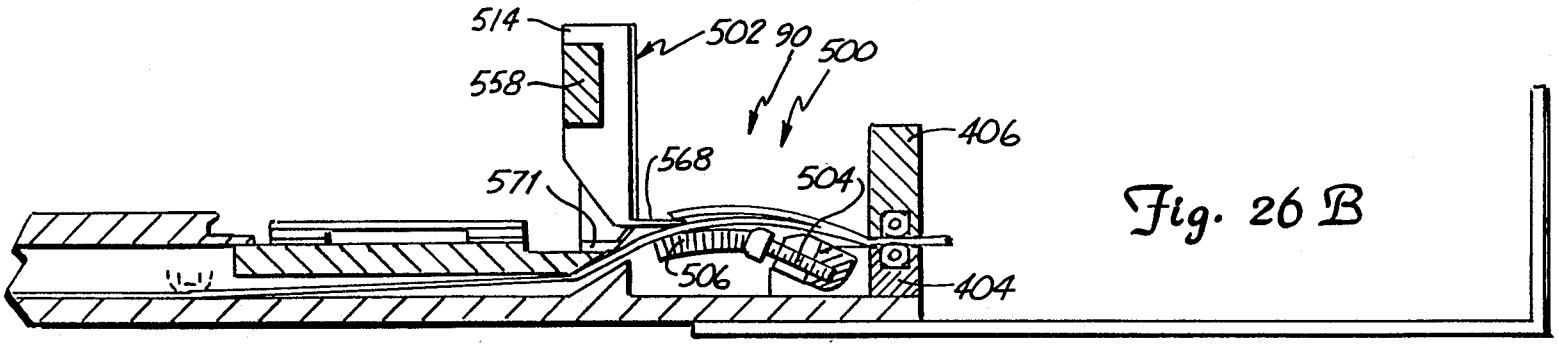

As driving arm 292 continues its forward motion, push bar fingers 300, 302 and 304 will engage photograph slides 22 in positions P1, P2 and P3, respectively, just as cam follower 522 is engaged by slot section 534 of cam 520. Further motion of driving arm 292 causes bell crank 524 to be rotated in a clockwise direction, forcing push rod 526 forward. During the initial part of this motion push rod 526 moves forward by a distance D. Arm 556 and elements attached thereto are driven forward by distance D, while spring 528 forces frame 512 and elements attached thereto to move forward by distance D until spacer 530 engages bushing 547. Moving portion 502 of pocket opening subassembly 90 is therefore driven forward by distance D. This distance sufficient to move the extending round edge formed by pocket engaging tabs 568 of fingers 514 forward, and into slots 30 of pockets 24 at positions P1–P3. Slots 30 were open due to the arching of sleeveing material 26 by stationary portion 500 of pocket opening subassembly 90. These actions are illustrated in FIGS. 24B, 25B and 26B.

Figure 26C:
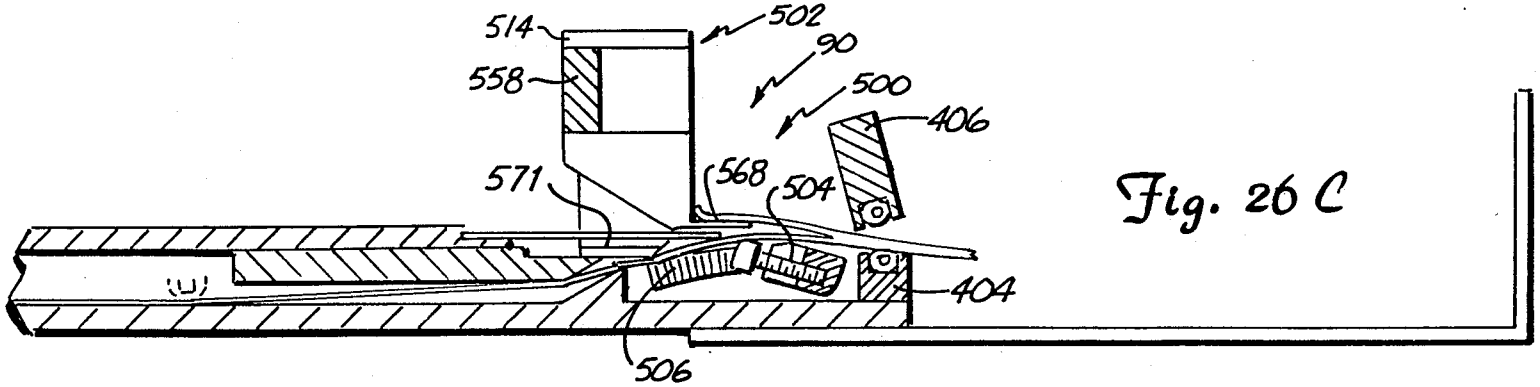
Figure 26D:
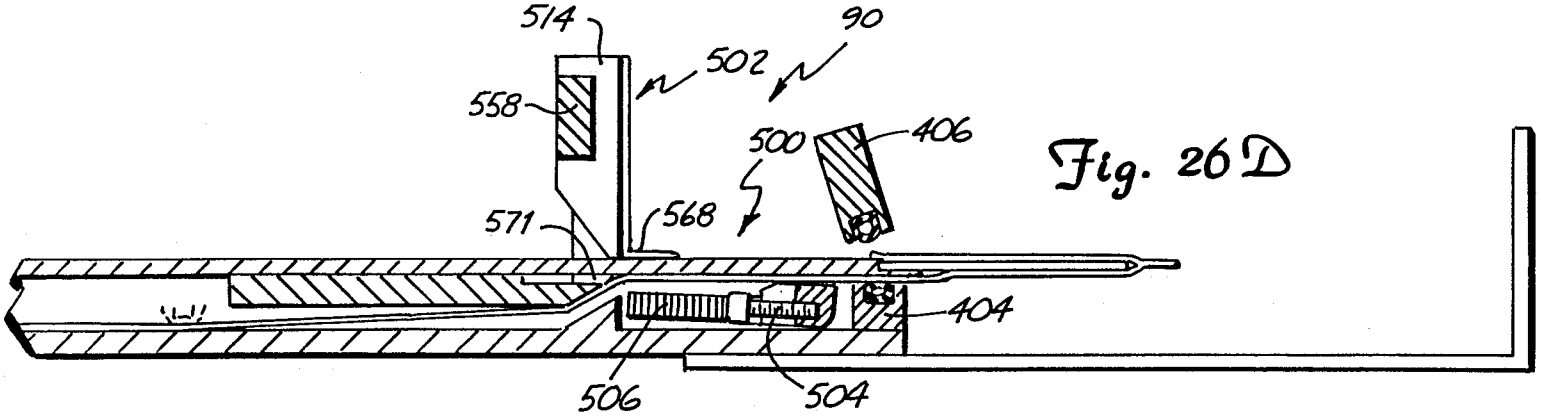
Figure 26E:
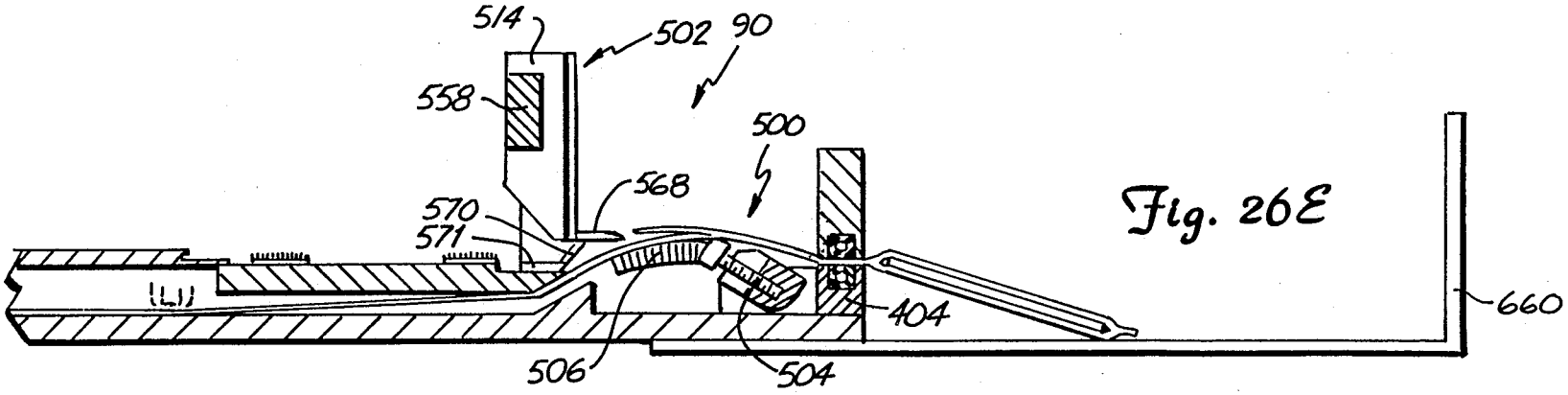

Further forward motion of driving arm 292 while cam follower 522 is within slot portion 534 of cam 520 causes bell crank 524 to force push rod 526 farther forward. However, following the initial motion described above, frame side member 554 cannot be pushed forward by spring 528 since spacer 530 has engaged bushing 547. The continued forward motion of push rod 526 therefore causes arm 556 and finger opening cams 578 to be forced forward, while finger mounting bar 558 on which fingers 514 are mounted remain stationary. As shown in FIGS. 24C, 25C and 26C, camming surfaces 582 of cams 578 force fingers 514 of each corresponding pair at slide insertion positions P1–P3 apart against the bias force of springs 574. Pocket engaging tabs 568 are then swung apart within opened pocket opening slots 30. Fingers 300, 302 and 304 of push bar 290 also engage photograph slides 22 in corresponding positions P1–P3 at this time, and push the photograph slides through slots 570 into opened pockets 24.

As slides 22 are being pushed into pockets 24, cam roller 436 is engaged by sloping surface 452 of guide and cam block 312. Forward arm section 440 of sleeve clamp actuating mechanism 402 is thereby rotated downward, permitting spring 412 to pivot upper clamp bar 406 in a rearward direction and open clamping mechanism 400. Sleeving material 26 can then be pushed forward and unwound from the roll to the extent that the force of photograph slides 22 being inserted into pockets 24 is greater than the force applied to the sleeving material by drag brake 18.

As forward motion of driving arm 292 continues, photograph slides 22 will be pushed completely into pockets 24, and the row of sleeved photograph slides pushed just beyond the forward edge of sleeve clamp 20. Slide sleever 10 is shown at this stage in FIGS. 25D and 26D. Since sleeving material 26 is moved forward by the force of fingers 300, 302 and 304 when slides 22 are being inserted into pockets 204, sleever 10 continuously self-aligns the sleeving material, placing it in position to have the next row of pockets filled with photograph slides.

After driving arm 292 has reached its fully extended position and pushed the row of sleeved photograph slides beyond sleeve clamp 20, it is retracted. Sleeve clamp 20 is therefore closed, and moving portion 502 of pocket opening subassembly 90 returned to its unactuated position. An adjacent row of pockets 24 will thereby be positioned adjacent insertion assembly 16 with pocket opening slots 30 immediately in front of closed fingers 514. The relative timing between opening and closing of sleeve clamp 20 and the motion of pocket opening subassembly moving portion 502 can be adjusted by the positioning of guide and cam block 312 and cam 520 on driving arm 292. All of the above procedures are then repeated until shut-off mechanism 600 senses the end of the roll of sleeving material 26, all photograph slides 22 are removed from hopper 28, or the main switch is turned off.

The embodiments shown in FIGS. 26A–E includes a sleeved photograph slide receiving tray 660 which extends from sleever 10 in front of sleeve clamp 20. As sleeved photograph slides 22 emerge from sleever 10 they will be supported within tray 660, with adjacent rows of slides fan-folding with respect to one another about perforations in sleeving material 26. Sleeved photograph slides 22 can then be conveniently torn from sleeving material 26 about the perforations when sleeve clamp 20 is closed.

Although the present invention has been described with reference to preferred embodiments, workers skilled in the art will recognize that changes may be made inform and detail without departing from the spirit and scope of the invention.

What is claimed is:

1. A sleeving system for inserting photograph slides into pockets of slide sleeving material having a plurality of rows of pockets, including:

slide positioning means for positioning photograph slides adjacent pocket opening slots of a row of pockets into which the photograph slides are to be inserted;

first pocket opening means for arcing the slide sleeving material adjacent the pockets so as to open the pocket opening slots, the first pocket opening means including:

first and second support means for supporting the slide sleeving material on opposite ends of the row of pockets into which the photograph slides are to be inserted; and extending member means extending into engagement with the sleeving material between the first and second support means and on a side of the sleeving material opposite the pocket opening slots, to arc the sleeving material adjacent the row of pockets into which slides are to be inserted; and slide pusher means for pushing the photograph slides into the pockets of the slide sleeving material through the pocket opening slots.

2. The sleeving system of claim 1 wherein the extending member means includes one or more elongated rigid lugs.

3. The sleeving system of claim 2 wherein each elongated lug is mounted to extend between the ends of the pockets in a generally perpendicular orientation to the pocket opening slots.

4. The sleeving system of claim 1 wherein the extending member means includes one or more resilient members.

5. The sleeving system of claim 4 wherein the resilient members are elongated members mounted to extend between the ends of the pockets in a generally perpendicular orientation to the pocket opening slots.

6. The sleeving system of claim 4 wherein the elongated resilient members include coil springs.

7. The sleeving system of claim 1 wherein:

the first and second support means support the slide sleeving material at opposite ends of the pockets at first and second levels, respectively; and the extending member means extends beyond the first and second levels into engagement with the slide sleeving material.

8. The sleeving system of claim 1 and further including second pocket opening means comprising:

pocket engaging tab edge means movably mounted adjacent the pocket opening slots at positions at which the photograph slides are to be inserted; and drive means for moving the pocket engaging tab edge means into the pocket opening slots opened by the first pocket opening means, for further opening the pockets.

9. The sleeving system of claim 8 wherein the drive means includes:

a motor; and mechanical linkage means coupling the motor to the pocket engaging tab edge means.

10. The sleeving system of claim 8 wherein:

the pocket engaging tab edge means includes:

first and second fingers having pocket engaging tab edges;

a finger mount;

mounting means for pivotally mounting the first and second fingers to the finger mount; and the second pocket opening means further includes:

biasing means for biasing the first and second fingers and causing the pocket engaging tab edges thereon to meet and form a tip extending toward the pocket opening slot, wherein the drive means drive the first and second fingers in a manner moving the tip into the pocket opening slots; and finger opening means for opening the fingers and forcing the pocket engaging tab edges thereon to opposite sides of the pockets.

11. The sleeving system of claim 10 wherein each finger includes a slot for supporting an edge of photograph slides and guiding the photograph slides into the pockets when the fingers are open.

12. The sleeving system of claim 10 wherein:

the finger opening means includes: cam engaging surfaces on the fingers; and a cam having diverging camming surfaces; and the drive means further includes means for driving the camming surfaces of the cam against the cam engaging surfaces of the fingers and causing the fingers to open against the force of the biasing means.

13. The sleeving system of claim 12 wherein the drive means further includes:

a motor; and mechanical linkage means coupling the motor to the finger mount and cam for driving the finger mount in a manner moving the tip into the pocket opening slot during a first stroke portion, and driving the cam with respect to the fingers causing the fingers to open during a second stroke portion after the first stroke portion.

14. A sleeving system for inserting photograph slides into pockets of an elongated web of sleeving material having a plurality of rows of pockets spaced from one another by a row spacing distance, including:

chassis base means for supporting the web of sleeving material for movement in a direction perpendicular to the rows of pockets;

hopper means for receiving photograph slides to be sleeved;

slide support means for supporting photograph slides in a row;

slide shuttle means for removing photograph slides from the hopper means and for moving the slides to the slide support means;

slide positioning means for positioning the photograph slides supported by the slide support means at slide positions corresponding to positions of the pockets in the row of slide sleeving material into which the slides are to be inserted;

pocket opening means for opening pockets of the row of slide sleeving material into which the photograph slides are to be inserted; and slide pusher means for pushing the photograph slides from their positions in the slide support means into the corresponding opened pockets of the row of sleeving material during a first push stroke portion, and for pushing the sleeved row of photograph slides and sleeving material beyond the pocket opening means by the row spacing distance during a second push stroke portion so as to align a next-adjacent row of pockets of the sleeving material with the pocket opening means and slide support means.

15. The sleeving system of claim 14 wherein the slide positioning means is mechanically coupled to the slide shuttle means.

16. The sleeving system of claim 14 and further including:

sleeve clamp means for releasably clamping the slide sleeving material with respect to the chassis base means; and sleeve clamp actuating means for causing the sleeve clamp means to clamp the sleeving material while the pusher means is pushing the slides into the pockets during the first push stroke portion, and to release the sleeving material while the pusher means is pushing the sleeved row of photograph slides and slide sleeving material from the pocket opening means and the slide support means during the second push stroke portion.

17. The sleeving system of claim 16 wherein the sleeve clamp means includes means for releasably clamping the slide sleeving material with respect to the chassis base means at locations opposite the pockets into which the slides are to be inserted from the pocket opening slots.

18. The sleeving system of claim 16 and further including coupling means for mechanically coupling the sleeve clamp actuating means to the slide pusher means.

19. The sleeving system of claim 14 and further including slide counting means coupled to the slide pusher means for counting photograph slides moved to positions in the slide support means by the slide positioning means, and for actuating the slide pusher means when photograph slides have been positioned in each position.

20. The slide sleeving system of claim 19 wherein the slide counting means is a mechanical mechanism.

21. The sleeving system of claim 19 wherein the slide counting means includes:

actuator bar means pivotally mounted with respect to the slide support means and having notches in a lower edge corresponding to photograph slide positions;

sensors for physically sensing the presence of photograph slides at each position in the slide support means and having lever arms which engage the lower edge of the actuator bar when a slide is not present at a position, and engage a corresponding notch in the actuator bar when a slide is sensed; and coupling means for actuating the slide pusher means when photograph slides have been moved to each position in the slide support means and the lever arms of the sensors are all aligned with the notches so as to permit the actuator bar to drop.

22. The sleeving system of claim 21 wherein the coupling means includes a switch coupled to the slide pusher means for sensing downward motion of the actuator bar.

23. The sleeving system of claim 21 and further including reset means for resetting the sensors after the actuator bar has dropped.

24. The sleeving system of claim 23 wherein the reset means includes means mechanically coupled to the slide positioning means for raising the actuator bar.

25. The sleeving system of claim 14 wherein the slide positioning means includes:

a guide member mounted with respect to the slide support means;

a moving member coupled to the slide shuttle means and movably mounted to the guide member for reciprocal motion between extended and retracted positions with the slide shuttle means; and a positioning bar slidably mounted to the moving member and having a first lip with a slide engaging face and a slide disengaging edge, the engaging face of the first lip engaging photograph slides moved to a first position by the slide shuttle means and moving the engaged slide to a second position when the moving member is moved to its extended position, and the disengaging edge causing the positioning bar to slide on the moving member and be disengaged from the photograph slide in the first position while the moving member is driven to its retracted position.

26. The sleeving system of claim 25 wherein the positioning bar further includes a second lip having a slide engaging face and a slide disengaging edge, the slide engaging face of the second lip engaging photograph slides moved to the second position by the first lip, and moving the slides from the second position to a third position while the moving member is moved to its extended position, and the disengaging edge causing the positioning bar to slide on the moving member and be disengaged from the slide in the second position while the moving member is moved back to its retracted position.

27. The sleeving system of claim 26 and further including biasing means for biasing the positioning bar in a manner preventing the second lip from engaging slides in the second position unless the first lip is engaged with a slide in the first position.

28. The sleeving system of claim 14 and further including drag brake means for applying a drag force to the slide sleeving material while sleeved photograph slides are being pushed by the slide pusher means.

29. The sleeving system of claim 14 and further including end-of-material sensor means for sensing an end of the web of slide sleeving material and providing signals representative thereof.

30. The sleeving system of claim 14 wherein the slide shuttle means includes:

a first arm section;

a slide pick on a first end of the first arm section;

pivot means for pivotally mounting the first arm section with respect to the chassis base; and drive means for reciprocally driving the first arm section between extended and retracted positions, wherein the slide pick engages a photograph slide in the hopper means and moves it to a first position in the slide support means when the arm is driven from its retracted position to its extended position, and wherein the slide pick is disengaged from photograph slides in the hopper means when the first arm section is driven from its extended position to its retracted position.

31. The sleeving system of claim 30 wherein the slide shuttle means further includes breakaway release means coupling the drive means to the first arm section, for absorbing motion of the drive means when the first arm section is jammed.

32. The sleeving system of claim 29 wherein the breakaway release means includes:

a second arm section having a first end coupled to the drive means;

pivot means for pivotally mounting a second end of the second arm section to a second end of the first arm section; and bias means for releasably biasing the second end of the second arm section into engagement with the second end of the first arm section.

33. The sleeving system of claim 14 wherein the slide support means includes:

forward and rearward slide edge support members for engaging forward and rearward edges, respectively, of the photograph slides and for supporting the photograph slides in the slide positions at a staging level above an insertion level;

pivot means for pivotally mounting one of the forward and rearward slide edge support members with respect to the chassis base means for movement between a closed position engaging the edges of the photograph slides, and an open position disengaged from the edges of the slides; and release means coupled to the slide positioning means and to the pivotally mounted slide edge support member, for causing the pivotally mounted support member to move to its open position and drop the slides from the staging level to the insertion level after the slides have been placed in their slide positions.

34. The sleeving system of claim 33 wherein:

the rearward slide edge support member includes a gate having a lower edge pivotally mounted to the chassis base by the pivot means for rocking motion between open and closed positions, and an upper edge for supporting the rearward edges of the photograph slides in the staging level when the gate is in its closed position; and the release means includes: bias means for biasing the gate toward its open position; and actuator means coupled to the slide positioning means for forcing the gate to its closed position while slides are being positioned, and for releasing the gate and causing the slides to be dropped to the insertion level after the slides have been placed in their slide positions.

35. The sleeving system of claim 34 wherein:

the gate includes a plurality of apertures adjacent the insertion level at locations corresponding to the slide positions; and the slide pusher includes a plurality of pusher fingers pushed through the apertures of the gate to engage the photograph slides.

36. The sleeving system of claim 34 and further including mechanical linkage means coupling the actuator means to the slide positioning means.

37. The sleeving system of claim 33 and further including slide counting means coupling the slide positioning means to the release means, for counting slides positioned by the positioning means and actuating the release means when the number of slides corresponding to the number of pockets in a row have been positioned.

38. The sleeving system of claim 34 and further including insertion support means for supporting the photograph slides above the chassis base at the insertion level.

39. The sleeving system of claim 14 wherein the slide pusher means includes:

a push block having a plurality of pusher fingers for engaging the photograph slides; and drive means for driving the push block between a retracted position at which the pusher fingers are disengaged from photograph slides, and an extended position at which the slides are engaged by the pusher fingers and pushed into pockets in the sleeving material.

40. The sleeving system of claim 39 wherein the drive means includes means for driving the push block through an extension stroke from the retracted position to the extended position at a first speed, and for driving the push block through a retraction stroke between the extended position and the retracted position at a second speed greater than the first speed.

41. The sleeving system of claim 40 wherein the drive means includes:

a pusher motor; and a mechanical linkage coupling the pusher motor to the push block.

42. The sleeving system of claim 39 and further including:

pusher start switch means responsive to the slide positioning means for actuating the drive means when the photograph slides have been placed in their slide positions; and pusher stop switch means responsive to the position of the push block for deactuating the drive means when the push block has returned to its retracted position.

43. A sleeving system for inserting photograph slides into pockets of an elongated web of sleeving material having a plurality of rows of pockets, including:

chassis base means for supporting the web of sleeving material for movement in a direction perpendicular to the rows of pockets;

hopper means for receiving photograph slides to be sleeved;

slide supporting means for releasably supporting a row of photograph slides at a slide staging level above the chassis base and above a slide insertion level;

slide moving means for removing photograph slides from the hopper means and for positioning the photograph slides in a row in the slide supporting means;

release means for releasing the slide supporting means and causing the photograph slides to drop to the insertion level;

pocket opening means for opening pockets of the row of slide sleeving material into which the photograph slides at the insertion level are to be inserted; and slide pusher means for pushing the photograph slides from their positions in the slide insertion level into the corresponding opened pockets of the row of sleeving material.

44. The sleeving system of claim 43 and further including slide counting means for counting photograph slides moved to positions in the slide supporting means, and for actuating the release means when a number of photograph slides corresponding to the number of pockets in the row of sleeving material have been moved to the slide supporting means.

45. The sleeving system of claim 44 wherein:

the slide counting means is a mechanical mechanism; and the sleeving system further includes a mechanical linkage coupling the slide counting means to the release means.

46. The sleeving system of claim 45 and further including mechanical linkage means coupling the slide counting means to the slide pusher means for actuating the slide pusher means after the photograph slides have been dropped to the insertion level.

47. A self-aligning system for inserting photograph slides into pockets of an elongated web of sleeving material having a plurality of rows with a predetermined number of pockets per row and spaced from one another by a predetermined row spacing distance, including:

hopper means for receiving photograph slides to be sleeved;

slide positioning means for removing photograph slides from the hopper means and positioning the slides adjacent pocket opening slots into which the photograph slides are to be inserted;

pocket opening means for opening the pockets in the row of sleeving material into which the photograph slides are to be inserted; and slide pusher means for engaging the photograph slides positioned by the slide positioning means, for pushing the photograph slides into the opened pockets, and for pushing the sleeved row of photograph slides and sleeving material by the row spacing distance so as to align a next-adjacent row of pockets of the sleeving material with the pocket opening means.

48. The system of claim 47 wherein the slide pusher means includes means for pushing the photograph slides into the opened pockets during a first push stroke portion, and for pushing the sleeved row of photograph slides and sleeving material by the row of spacing distance during a second push stroke portion.

49. The system of claim 48 and further including: sleeve clamp means for releasably clamping the sleeving material; and sleeve clamp actuating means for causing the sleeve clamp means to clamp the sleeving material while the pusher means is pushing the slides into the pockets during the first push stroke portion, and to release the sleeving material while the pusher means is pushing the sleeved row of photograph slides and slide sleeving material during the second push stroke portion.

50. The system of claim 49 and further including mechanical linkage means coupling the sleeve clamp actuating means to the slide pusher means.

51. The system of claim 47 and further including a drag break for applying a drag force to the sleeving material.

52. A photograph slide sleeving system for inserting photograph slides into pockets of an elongated web of sleeving material having a plurality of rows of a predetermined number of pockets per row and spaced from one another by a predetermined row spacing distance, including:

chassis base means for supporting the web of sleeving material for movement in a direction perpendicular to the rows of pockets;

hopper means for receiving photograph slides to be sleeved;

slide support means for supporting photograph slides in a row;

slide shuttle means for removing photograph slides from the hopper means and for moving the slides to a first position on the slide support means;

slide positioning means mechanically coupled to the slide shuttle means for moving slides from the first position to second and any subsequent slide positions corresponding to positions of the pockets in the row of slide sleeving material into which the slides are to be inserted;

first pocket opening means for arcing the slide sleeving material adjacent the pockets so as to open the pockets of the row of pockets into which the photograph slides are to be inserted;

slide counting means for mechanically counting photograph slides moved to positions in the slide support means by the slide positioning means;

slide pusher means coupled to the slide counter means and actuated when the predetermined number of slides have been positioned on the slide support means, for pushing the photograph slides from their positions in the slide supporting means into the corresponding open pockets of the row of sleeving material during a first push stroke portion, and pushing the sleeved row of photograph slides and sleeving material beyond the pocket opening means by the row spacing distance during a second push stroke portion so as to align a next-adjacent row of pockets of the sleeving material with the pocket opening means and slide support means;

sleeve clamp means for releasably clamping the slide sleeving material with respect to the chassis base means; and sleeve clamp actuating means mechanically coupled to the slide pusher means for causing the sleeve clamp means to clamp the sleeving material while the pusher means is pushing the slides into the pockets during the first push stroke portion, and to release the sleeving material while the pusher means is pushing the sleeved row of photograph slides and slide sleeving material from the pocket opening means during the second push stroke portion.

53. The sleeving system of claim 52 and further including second pocket opening means comprising:

pocket engaging tab edge means movably mounted adjacent the pockets at positions at which the photograph slides are to be inserted; and drive means mechanically coupled to the slide pusher means for moving the pocket engaging tab edge means into the pockets opened by the first pocket opening means, for further opening the pockets.

54. The system of claim 53 wherein:

the pocket engaging tab edge means includes:

first and second fingers having pocket engaging tab edges;

a finger mount; and mounting means for pivotally mounting the first and second fingers to the finger mount; and the second pocket opening means further includes:

biasing means for biasing the first and second fingers and causing the pocket engaging tab edges thereon to meet and form a tip extending toward the pocket, wherein the drive means drives the first and second fingers in a manner moving the tip into the pocket; and finger opening means for opening the fingers and forcing the pocket engaging tab edges thereon to opposite sides of the pockets.

55. The sleeving system of claim 54 wherein each finger includes a slot for supporting an edge of photograph slides and guiding the photograph slides into the pockets when the fingers are opened.

56. The sleeving system of claim 54 wherein:

the finger opening means includes:

cam engaging surfaces on the fingers; and a cam having diverging camming surfaces; and the drive means further includes:

means for driving the camming surfaces of of the cam against the cam engaging surfaces of the fingers and causing the fingers to open against the force of the bias means.

57. The sleeving system of claim 54 wherein the drive means includes:

a motor; and mechanical linkage means coupling the motor to the finger mount and cam, for driving the finger mount in a manner moving the tip into the pocket during a first stroke portion, and driving the cam with respect to the fingers causing the fingers to open during a second stroke portion after the first stroke portion.

58. The sleeving system of claim 52 wherein the first pocket opening means includes:

first and second support means for supporting the slide sleeving material on opposite ends of the pockets into which the photograph slides are to be inserted; and extending member means extending into engagement with the sleeving material between the first and second support means and on a side of the sleeving material opposite pocket opening slots, to arc the sleeving material adjacent the pockets into which the slides are to be inserted.

59. The sleeving system of claim 60 wherein the extending member means includes elongated lugs mounted to extend between the ends of the pockets in a generally perpendicular orientation to the pocket opening slots.

60. The sleeving system of claim 58 wherein the extending member means includes elongated resilient members mounted to extend between the ends of the pockets.

61. The sleeving system of claim 52 wherein the slide counting means includes:

actuator bar means pivotally mounted with respect to the slide support means and having notches in a lower edge corresponding to photograph slide positions;

sensors for physically sensing the presence of photograph slides at each position in the slide support means and having lever arms which engage the lower edge of the actuator bar when a slide is not present at a position, and engage a corresponding notch in the actuator bar when a slide is sensed; and coupling means for actuating the slide pusher means when photograph slides have been moved to each position in the slide support means and the lever arms are aligned with the notches so as to permit the actuator bar to drop.

62. The slide sleeving system of claim 61 and further including reset means mechanically coupled to the slide positioning means for raising the actuator bar and resetting the sensors after the actuator bar has dropped.

63. The sleeving system of claim 52 wherein the slide positioning means includes:

a guide member mounted with respect to the slide support means;

a moving member coupled to the slide shuttle means and movably mounted to the guide member for reciprocal motion between extended and retracted positions with the slide shuttle means; and a positioning bar slidably mounted to the moving member and having a first lip with a slide engaging face and a slide disengaging edge, the engaging face of the first lip engaging photograph slides moved to a first position by the slide shuttle means and moving the engaged slide to a second position when the moving member is moved to its extended position, and the disengaging edge causing the positioning bar to slide on the moving member and be disengaged from the photograph slide in the first position while the moving member is driven to its retracted position.

64. The sleeving system of claim 63 wherein the positioning bar further includes a second lip having a slide engaging face and a slide disengaging edge, the slide engaging face of the second lip engaging photograph slides moved to the second position by the first lip, and moving the slides from the second position to a third position while the moving member is moved to its extended position, and the disengaging edge causing the positioning bar to slide on the moving member and be disengaged from the slide in the second position while the moving member is moved back to its retracted position.

65. The sleeving system of claim 64 and further including biasing means for biasing the positioning bar in a manner preventing the second lip from engaging slides in the second position unless a first lip is engaged with a slide in the first position.

66. The slide sleeving system of claim 52 and further including drag brake means for applying a drag force to the slide sleeving material while the sleeved photograph slides are being pushed by the slide pusher means.

67. The sleeVing system of claim 52 wherein the slide support means includes:

forward and rearward slide edge support members for engaging forward and rearward edges, respectively, of the photograph slides and for supporting the photograph slides in the slide positions at a stating level above the insertion level;

pivot means for pivotally mounting one of the forward and rearward slide edge support members with respect to the chassis base means for movement between a closed position engaging the edges of the photograph slides, and an open position disengaged from the edges of the slides; and release means coupled to the slide positioning means and to the pivotally mounted slide edge support member, for causing the pivotally mounted support member to move to its open position and drop the slides from the staging level to the insertion level after the slides have been placed in their slide positions.

68. The sleeving system of claim 67 wherein:

the rearward slide edge support member includes a gate having a lower edge pivotally mounted to the chassis base by the pivot means for rocking motion between open and closed positions, and an upper edge for supporting the rearward edges of the photograph slides in the staging level when the gate is in its closed position; and the release means includes:

bias means for biasing the gate toward its open position; and actuator means coupled to the slide positioning means for forcing the gate to its closed position while slides are being positioned, and for releasing the gate and causing slides to be dropped to the insertion level after the slides have been placed in their slide positions.

69. A sleeving system for inserting photograph slides into pockets of slide sleeving material having a plurality of rows of pockets, including:

slide positioning means for positioning photograph slides adjacent pocket opening slots of a row of pockets into which the photograph slides are to be inserted;

a pocket opening mechanism adjacent each pocket of the row, for opening the pocket, each pocket opening mechanism including:

first and second fingers having pocket engaging tab edges;

a finger mount;

mounting means for pivotally mounting the first and second fingers to the finger mount;

biasing means for biasing the first and second fingers and causing the pocket engaging tab edges thereon to meet and form a tip extending toward the pocket opening slot;

drive means for driving the first and second fingers in a manner moving the tip into the pocket opening slot; and finger opening means for opening the fingers and forcing the pocket engaging tab edges thereon to opposite sides of the pockets; and slide pusher means for pushing the photograph slides into the pockets of the slide sleeving material through the pocket opening slots.

70. The sleeving system of claim 69 wherein each finger includes a slot for supporting an edge of photograph slides and guiding the photograph slides into the pockets when the fingers are open.

71. The sleeving system of claim 70 wherein:

the finger opening means includes: cam engaging surfaces on the fingers; and a cam having diverging camming surfaces; and the drive means further includes means for driving the camming surfaces of the cam against the cam engaging surfaces of the fingers and causing the fingers to open against the force of the biasing means.

72. The sleeving system of claim 71 wherein the drive means further includes:

a motor; and mechanical linkage means coupling the motor to the finger mount and cam for driving the finger mount in a manner moving the tip into the pocket opening slot during a first stroke portion, and driving the cam with respect to the fingers causing the fingers to open during a second stroke portion after a first stroke portion.

* * * * *

UNITED STATES PATENT AND TRADEMARK OFFICE

CERTIFICATE OF CORRECTION

PATENT NO. : 4,977,725

DATED : December 18, 1990

INVENTOR(S) : Wilbur Gerrans et al.

It is certified that error appears in the above-identified patent and that said Letters Patent is hereby corrected as shown below:

Col. 31, line 63, delete "sleeVing", insert --sleeving--

Signed and Sealed this

Thirteenth Day of October, 1992

*Attest:*

DOUGLAS B. COMER

*Attesting Officer*

*Acting Commissioner of Patents and Trademarks*